US007141343B2

(12) United States Patent
Takiguchi et al.

(10) Patent No.: US 7,141,343 B2
(45) Date of Patent: Nov. 28, 2006

(54) TONER, METHOD FOR FORMING IMAGE USING THE TONER, AND PROCESS CARTRIDGE

(75) Inventors: Tsuyoshi Takiguchi, Shizuoka (JP); Yosuke Morikawa, Kanagawa (JP); Takashige Kasuya, Shizuoka (JP); Kimihiro Yoshimura, Kanagawa (JP); Katsuhisa Yamazaki, Shizuoka (JP); Kaori Hiratsuka, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 302 days.

(21) Appl. No.: 10/418,215

(22) Filed: Apr. 18, 2003

(65) Prior Publication Data

US 2004/0043315 A1 Mar. 4, 2004

(30) Foreign Application Priority Data

Apr. 19, 2002 (JP) ..... 2002-117109

(51) Int. Cl.
*G03G 9/08* (2006.01)

(52) U.S. Cl. ..... 430/108.6; 430/111.41; 430/108.7; 430/111.4

(58) Field of Classification Search ..... 430/108.6, 430/108.7, 108.1, 111.41, 111.4, 106.1, 108.3
See application file for complete search history.

(56) References Cited

U.S. PATENT DOCUMENTS

| | | | | |
|---|---|---|---|---|
| 4,851,865 | A | 7/1989 | Ehara et al. | 346/160.1 |
| 5,429,902 | A * | 7/1995 | Saito et al. | 430/108.3 |
| 5,541,030 | A * | 7/1996 | Sano et al. | 430/109.4 |
| 6,128,456 | A | 10/2000 | Chigono et al. | 399/176 |
| 6,301,456 | B1 | 10/2001 | Horrall et al. | 399/111 |
| 6,415,121 | B1 | 7/2002 | Suzuki et al. | 399/111 |
| 6,537,715 | B1 | 3/2003 | Mizoo et al. | 430/110.3 |
| 2001/0002305 | A1* | 5/2001 | Yuasa et al. | 430/110 |
| 2002/0037179 | A1 | 3/2002 | Suzuki et al. | 399/111 |
| 2003/0016955 | A1 | 1/2003 | Hiratsuka et al. | 399/27 |
| 2003/0021612 | A1 | 1/2003 | Morikawa et al. | 399/159 |

FOREIGN PATENT DOCUMENTS

| | | | |
|---|---|---|---|
| EP | 0 334 099 | A2 | 9/1989 |
| EP | 0 681 224 | A1 | 11/1995 |
| EP | 0 784 237 | A2 | 7/1997 |
| JP | 59-224851 | A | 12/1984 |
| JP | 60-69660 | | 4/1985 |
| JP | 63-271469 | A | 11/1988 |
| JP | 5-53482 | | 3/1993 |
| JP | 6-345429 | | 12/1994 |
| JP | 8-272146 | A | 10/1996 |
| JP | 10-307456 | | 11/1998 |
| JP | 2001-51446 | A | 2/2001 |

OTHER PUBLICATIONS

Klein, Cornelius et al. Manual of Mineralogy. New York: John Wiley & Sons (1985) pp. 304 & 570.*
Partial English translation of the Mar. 17, 2006 Chinese Office Action.
Mar. 17, 2006 Chinese Office Action in 03122173.4.

* cited by examiner

*Primary Examiner*—Christopher Rodee
(74) *Attorney, Agent, or Firm*—Fitzpatrick, Cella, Harper & Scinto

(57) ABSTRACT

A toner exhibits excellent image characteristics, and also has an excellent charging property even if the toner is used in a cleaning-simultaneous-with-developing system having a direct injection charging mechanism. The toner includes toner particles and non-magnetic metallic-compound fine particles. The weight average particle diameter of the toner is 3.0 μm to 12.0 μm. The metallic-compound fine particles are conductive metallic-compound fine particles having a specific surface area ($cm^2/cm^3$) of $5\times10^5$ to $100\times10^5$; a medium diameter ($D_{50}$) of 0.4 μm to 4.0 μm with respect to a volume-based particle diameter distribution, the medium diameter ($D_{50}$) being smaller than the weight average particle diameter of the toner; and a 90% particle diameter $D_{90}$ of 6.0 μm or less with respect to a volume-based particle diameter.

12 Claims, 1 Drawing Sheet

TONER, METHOD FOR FORMING IMAGE USING THE TONER, AND PROCESS CARTRIDGE

BACKGROUND OF THE INVENTION

1. Field of the Invention

The present invention relates to a toner to be used in an electrophotographic process, an electrostatic recording process, or a toner jet process, and also relates to an image forming method using the toner. Furthermore, the present invention relates to a process cartridge which can be removably attached on an image forming apparatus, such as a copying machine, a printer, a facsimile machine, or a plotter, where a toner image is formed on a transfer member by forming the toner image on an image bearing member and transferring the toner image to the transfer member.

2. Description of the Related Art

The electrophotographic process is a process for obtaining an image by forming an electrostatic latent image on an image bearing member such as a photoreceptor having a photoconductive material, forming a toner image by developing the latent image with toner, followed by transferring the toner image on a transfer member such as a sheet of paper, and fixing the toner image on the transfer material by the application of heat and pressure to obtain an image. In general, the process comprises a step of cleaning in which the toner that has failed to be transferred and remained on the image bearing member is cleaned up after the transcription and is then stored as waste toner in a waste-toner container. Then, the above steps are repeated.

In contrast to such a method, JP 5-53482 A proposes an image forming method regarded as a development-cleaning system or a cleanerless system as a system that generates no waste toner. In this document, however, there is no concrete description about the whole configuration of such a system.

In JP 10-307456 A, there is proposed a direct-injection charging method as an environmentally preferable technology without the generation of an active ion such as ozone, by which a development-cleaning system can be attained with a contact-development or non-contact-development method. For example, there is proposed an image forming apparatus in which a developer containing toner particles and conductive charging-promoting particles having a particle diameter of ½ or less of the toner particle diameter are applied in the image forming method having the development-cleaning step using the direct-injection charging method. Such an image forming apparatus does not generate discharged products, so that it is possible to considerably decrease the amount of the waste toner and reduce the size of the apparatus at a lower cost, and provide an excellent image without causing poor charging or dispersion or lowering of light-transmittance for image exposure. Even though a preferable particle diameter of the charging-promoting particles having a conductive property is described, there is no description about a preferable particle diameter distribution of the charging-promoting particles. Therefore, further improvements are required for obtaining stable performance thereof.

JP 60-69660 A suggests the external addition of conductive fine powder of tin oxide, zinc oxide, or titanium oxide in high-resistance magnetic toner particles. However, it has been expected to develop toner in which an external additive more preferably used in injection charging is externally added.

Furthermore, JP 6-345429 A suggests conductive ultra-fine powder of tin oxide subjected to a reduction treatment.

However, such a suggestion aims to disperse conductive ultra-fine powder of tin oxide in a polymer to provide the polymer with conductivity and there is no description about an improvement in a frictional charging property by externally adding and mixing a conductive ultra-fine powder of tin oxide in toner particles and also there is no description about the toner to be used in an image forming method having the step of injection charging.

SUMMARY OF THE INVENTION

An object of the present invention is to provide toner capable of solving the problems described above.

That is, the object of the present invention is to provide toner having an excellent environmental stability.

Another object of the present invention is to provide toner preferably applied in an image forming method using a direct injection-charging system.

Also, another object of the present is to provide toner that hardly generates a ghost image even under a low-temperature and low-humidity environment.

Further, another object of the present invention is to provide an image forming method using the above-mentioned toner.

Still further, another object of the present invention is to provide a process cartridge having the above-mentioned toner.

The inventors of the present invention have been dedicated to repeatedly make studies for solving the above-mentioned problems and finally found the present invention.

That is, according to the present invention, there is provided a toner comprising at least toner particles, and non-magnetic, metallic-compound fine particles and inorganic fine powder both existing on the surface of the toner particles, in which:

the toner particles comprise at least a binder resin and a colorant;

a weight-average particle diameter A of the toner is 3.0 μm to 12.0 μm; and the metallic-compound fine particles are conductive metallic-compound fine particles which have a specific surface area ($cm^2/cm^3$) of $5\times10^5$ to $100\times10^5$; a median diameter ($D_{50}$) of 0.4 μm to 4.0 μm with respect to a volume-based particle diameter distribution, the median diameter ($D_{50}$) being smaller than a weight-average particle diameter A of the toner; and a 90% particle diameter $D_{90}$ of 6.0 μm or less with respect to a volume-based particle diameter distribution.

Furthermore, according to the present invention, there is provided a method for forming an image, comprising the step of:

charging an image bearing member by applying a voltage on a charging member being in contact with the image bearing member;

forming an electrostatic latent image on the charged image bearing member;

developing a toner image by transferring toner carried on a toner carrying member to the electrostatic latent image retained on the surface of the image bearing member; and transferring the toner image formed on the image bearing member to a transfer material directly or through an intermediate transfer member, wherein:

the toner comprises at least toner particles, and non-magnetic, metallic-compound fine particles and inorganic fine powder both existing on the surface of the toner particles;

the toner particles comprise at least a binder resin and a colorant;

a weight-average particle diameter A of the toner is 3.0 μm to 12.0 μm; and the metallic-compound fine particles are: conductive metallic-compound fine particles which have a specific surface area ($cm^2/cm^3$) of $5\times10^5$ to $100\times10^5$; a median diameter ($D_{50}$) of 0.4 μm to 4.0 μm with respect to a volume-based particle diameter distribution, the median diameter ($D_{50}$) being smaller than a weight-average particle diameter A of the toner; and a 90% particle diameter $D_{90}$ of 6.0 μm or less with respect to a volume-based particle diameter distribution.

Furthermore, according to the present invention, there is provided a process cartridge detachably attached to a main body of an image forming apparatus by which an electrostatic latent image formed on an image bearing member is developed with toner in a developing unit to form a toner image, and the toner image is transferred to a transfer material to form an image, in which:

the process cartridge comprises at least an image bearing member that retains an electrostatic latent image, and the developing unit opposite to the image bearing member;

the developing unit includes at least a toner carrying member and a toner layer regulating member for forming a toner layer on the toner carrying member;

the toner comprises at least toner particles, and non-magnetic, metallic-compound fine particles and inorganic fine powder both existing on the surface of the toner particles;

the toner particles comprise at least a binder resin and a colorant;

a weight-average particle diameter A of the toner particles is 3.0 μm to 12.0 μm, and the metallic-compound fine particles are conductive metallic-compound fine particles which have a specific surface area ($cm^2/cm^3$) of $5\times10^5$ to $100\times10^5$, a medium diameter ($D_{50}$) of 0.4 μm to 4.0 μm with respect to a volume, the median diameter ($D_{50}$) being smaller than the weight-average particle diameter A of the toner, and a 90% particle diameter $D_{90}$ of 6.0 μm or less with respect to a volume-based particle diameter distribution.

BRIEF DESCRIPTION OF THE DRAWINGS

Other objects and advantages of the invention will become apparent during the following discussion conjunction with the accompanying drawings, in which.

DETAILED DESCRIPTION OF THE INVENTION

Figure 1:
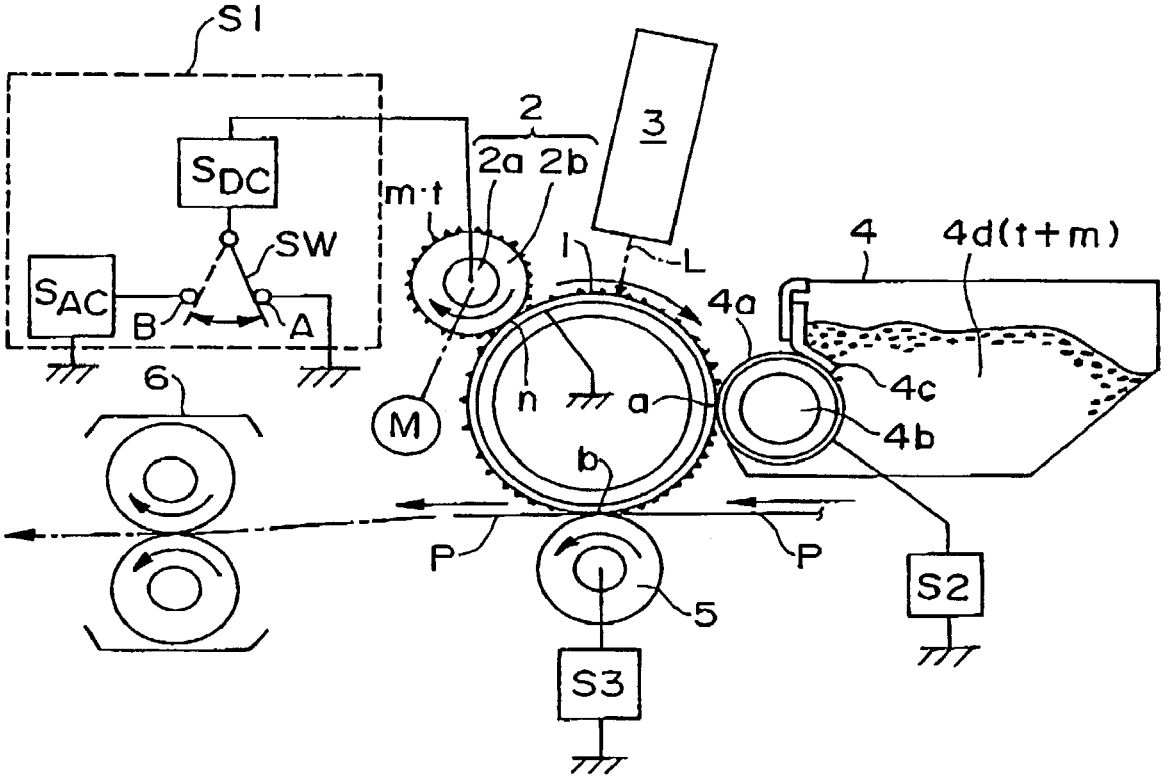
FIG. 1 is a schematic diagram for illustrating an exemplified image forming apparatus to be used in the present invention.

For improving image characteristics by blending toner particles with externally added conductive fine particles, attention is mainly given to the average particle diameter so that the conductive fine particles are selected in many cases. However, considering the interaction between the toner particles and the conductive fine particles, the densities of points of contact between those particles are particularly important in the case of the toner used in a method for forming an image having the step of direct injection-charging.

The toner of the present invention has a weight-average particle diameter in the range of 3.0 μm to 12.0 μm, preferably 5.0 μm to 10.0 μm. If the weight average particle diameter of the toner is smaller than 3.0 μm, a decrease in transfer efficiency and fogging are likely to occur. On the other hand, if the weight average particle diameter of the toner is larger than 12.0 μm, the resolution performance is degraded.

In the present specification, the weight-average particle diameter of the toner is estimated as follows. For instance, a Coulter Multisizer (manufactured by Coulter Inc.) is used, and is connected to an interface (manufactured by Nikkaki Co., Ltd.) and a PC-9801 personal computer (manufactured by NEC Corporation), which produce a number-based distribution and a volume-based distribution. A 1%-NaCl aqueous solution as an electrolyte solution is prepared by using a reagent grade sodium chloride. 0.1 to 5 ml of a surfactant (preferably, an alkyl benzene sulfonate) as a dispersant is added in 100 to 150 ml of the electrolyte solution, and 2 to 20 mg of a sample to be measured is added thereto. The sample-suspending electrolyte solution is subjected to a dispersion treatment for about 1 to 3 minutes using an ultrasonic dispersing device. Subsequently, the volume and number of particles with diameters of 2 μm or more are measured by the Coulter Multisizer using a 100 μm aperture to calculate the volume-based distribution and number-based distribution of toner. Subsequently, the weight-average particle diameter ($D_4$) of the toner with respect to a volume-based distribution is obtained.

The toner of the present invention comprises toner particles, and non-magnetic fine particles of a metallic compound and inorganic fine powder both existing on the surface of the toner particles. The metallic-compound fine particles are non-magnetic or substantially non-magnetic. If the metallic-compound fine particles have a magnetic property, when the metallic-compound fine particles are mixed with magnetic toner particles, the metallic-compound fine particles released from the magnetic toner particles are adhered on a toner-carrying member to contaminate the surface of the toner-carrying member.

The metallic-compound fine particles have a specific surface area ($cm^2/cm^3$) in the range of $5\times10^5$ to $100\times10^5$.

In order to stably obtain sufficient toner performance and to prevent the forming of an abnormal image resulting from poor charging even when printing is performed directly after stopping the main unit of the image forming apparatus due to a sudden abnormality thereof, the contact density between the metallic-compound fine particles and the toner particles and the contact density between the metallic-compound fine particles and the surface of a charging member become important.

In general, when spherical particles are brought into contact with a flat member, the number of the points of contact is 1 (one). It is just as valid for the contact between the metallic-compound fine particles and the charging member or toner particles. By forming many irregularities on the surfaces of the metallic-compound fine particles, the number of the points of contact between the metallic-compound fine particles and the toner particles or the charging member can be increased, because projected portions on the surface of the metallic-compound fine particles to be brought into contact to the toner of the charging member would be increased. In terms of frictional charging characteristics, however, the formation of many irregularities on the surfaces of toner particles is not preferable. On the other hand, the formation of irregularities on the surfaces of the metallic-compound fine particles allows an increase in the number of contact points not only with the toner particles but also with the charging member, so that the design freedom of the charging member can be broadened. The use of the metallic-compound fine particles having many irregularities on the surfaces thereof is applicable to various kinds of printers and various kinds of toner.

As an index of the number of irregularities formed on the surfaces of the metallic-compound fine particles, a specific surface area is generally used. However, the specific surface area generally used in the art is a surface area per unit mass and is represented by the unit of "$cm^2/g$". For this kind of specific surface area, it is not easy to compare the specific surface areas of materials having different specific gravities and to optimize the specific surface area. Therefore, the inventors of the present invention adopted the unit of "$cm^2/cm^3$" that corresponds to the surface area per volume of one metallic-compound fine particle as a specific surface area and studied the relationship between: the number of contact points between the metallic-compound fine particles and the toner particles and charging member; and the image characteristics and charging property.

Consequently, it has been found that the charging property and image characteristics are substantially improved when the specific surface area ($cm^2/cm^3$) of the metallic-compound fine particles contained in the toner is in the range of $5\times10^5$ to $100\times10^5$ with the image forming method having the step of contact charging. In particular, as for the image forming method having a direct injection-charging mechanism, it has been found that an excellent charging property can be retained even though the charging member is contaminated. Those effects are due to an increase in the number of contact points between the metallic-compound fine particles and the toner particles and the charging member. In this case, however, when the specific surface area is larger than the above range and excessive projected portions are formed on the surfaces of the metallic-compound fine particles, the adhesive strength between the toner particles and the metallic-compound fine particles is too strong. Thus, the metallic-compound fine particles are moved on a transfer material together with the toner in the step of transfer, so that they do not remain on an image-bearing member (e.g., a photosensitive member). Therefore, the improvement effect of the charging property by the metallic-compound fine particles in the step of charging will be lowered. For avoiding such a phenomenon, the specific surface ($cm^2/cm^3$) of the metallic-compound fine particles may be preferably $10\times10^5$ to $80\times10^5$, more preferably $12\times10^5$ to $40\times10^5$ to further improve the charging property by the metallic-compound fine particles and the image forming characteristics of the toner.

Here, a description will be provided of the specific surface area of the metallic-compound fine particles.

In the case of the spherical fine particles, when the particle radius thereof is defined as r(cm), the surface area of one fine particle is $4\times\pi\times r^2$ and the volume of the one fine particle is $(4/3)\times\pi\times r^3$. Thus, the surface area of the fine particles per unit volume can be calculated from the following equation.

$$(\text{Surface area per fine particle})/(\text{volume per fine particle})=3/r$$

Using a median diameter ($D_{50}$) with respect to a volume-based particle size distribution, the following relationship is established:

$$r(\text{cm})=D_{50}(\mu\text{m})/(2\times10^4).$$

Therefore, the specific surface area of particles is represented by the following equation:

$$\text{Specific surface area } (cm^2/cm^3)=6\times10^4/D_{50}.$$

Although, more or less, the fine particles have no regular form, the specific surface area ($cm^2/cm^3$) of the fine particles may be approximately $10\times10^4/D_{50}$. Since the median diameter ($D_{50}$) of the metallic-compound fine particles used in the present invention is in the range of 0.4 to 4.0 μm, if the metallic-compound fine particles have a normal surface property, the specific surface area of the fine particles should be only approximately $2.5\times10^5$. In this case, however, the specific surface area of such a value provides an insufficient number of the contact points between the fine particles and the toner particles or the charging member, so that any excellent effect cannot be expected.

According to the studies conducted by the inventors of the present invention, favorable effects have been obtained when the metallic-compound fine particles satisfy the following relationship:

$$5\times10^5/D_{50}<(\text{the specific surface area } (cm^2/cm^3) \text{ of the metallic-compound fine particles per unit volume}).$$

On the other hand, excess irregularities are formed on the surfaces of the metallic-compound fine particles when the metallic-compound fine particles satisfy the following relationship:

$$100\times10^5/D_{50}<(\text{the specific surface area } (cm^2/cm^3) \text{ of the metallic-compound fine particles per unit volume}).$$

This is not preferable because fogging is likely to occur, as the interaction between the metallic-compound fine particles and the toner particles is too strong.

In the present specification, the specific surface area ($cm^2/cm^3$) of the metallic-compound fine particles is obtained as follows.

According to the Brunauer-Emmett-Teller (BET) method, nitrogen gas is adsorbed on the surface of a sample and then the BET specific surface area ($cm^2/g$) of the sample is calculated using the multipoint BET nitrogen adsorption method with a specific surface area analyzer, "Gemini 2375 Ver. 5.0" (manufactured Shimadzu Corporation), or the like.

Subsequently, the true density ($g/cm^3$) of the sample was obtained using a dry automatic densitometer, "Accupyc 1330" (manufactured by Shimadzu Corporation), or the like. At this time, a 10 $cm^3$ sample vessel is used and the sample is pretreated with a helium gas purge at a highest pressure of 19.5 psig ten times. Subsequently, as a criterion for determining pressure equilibrium, i.e., whether the inner pressure of the vessel reaches equilibrium, the fluctuation of inner pressure in the sample chamber is based on a level of 0.0050 psig/min. When the fluctuation of inner pressure in the sample chamber is not more than such a level, it is regarded that the inner pressure is in equilibrium, and that the true density of the sample is automatically measured. The measurements are repeated five times and the mean value of the results of the measurements is obtained as the true density of the sample.

Here, the specific surface area of the metallic-compound fine particles is calculated by the following equation.

$$(\text{Specific surface area } (cm^2/cm^3))=(\textit{BET} \text{ specific surface area } (cm^2/g))\times(\text{true density } (g/cm^3))$$

The metallic-compound fine particles are conductive metallic-compound fine particles where the median diameter ($D_{50}$) thereof is in the range of 0.4 μm to 4.0 μm on the basis of volume, but smaller than the weight-average particle diameter A of the toner, and $D_{90}$ is 6.0 μm or less.

Generally, the larger the difference between particle diameters of these particles, the stronger the adhesion with the interaction between particles. One of the effects of the metallic-compound fine particles used in the present invention is an improvement in frictional charging characteristics by contact friction between the metallic-compound fine particles and the toner particles. Therefore, such an effect can be lowered when the metallic-compound fine particles and the toner particles are strongly adhered to each other. The toner of the present invention has a weight-average particle diameter in the range of 3.0 μm to 12.0 μm, and an appropriate median diameter ($D_{50}$) of the metallic-compound fine particles is in the range of 0.4 μm to 4.0 μm. When the $D_{50}$ of the metallic-compound fine particles is less than 0.4 μm, the metallic-compound fine particles are hardly separated from the toner particles and have a little effect on the improvement of frictional charging characteristics. Therefore, it is difficult to obtain high image density.

On the other hand, when the $D_{50}$ of the metallic-compound fine particles becomes larger than 4.0 μm, the interaction between the metallic-compound fine particles and the toner particles is weakened, resulting in a degradation in the effect of improving the frictional charging characteristics. When the $D_{50}$ of the metallic-compound fine particles is the same as or larger than the weight-average particle diameter A of the toner, the effect of such an interaction is hardly observed. In this case, furthermore, the metallic-compound fine particles act as an electrode under a development field, so that the toner movement can be inhibited. Therefore, fogging is likely to occur and the resolution deteriorates. More preferably, the $D_{50}$ of the metallic-compound fine particles is in the range of 0.5 μm to 3.5 μm.

In the metallic-compound fine particles, those having extremely large particle diameters should be few in number. When the 90% particle diameter $D_{90}$ with respect to a volume-based particle size distribution is used as a index of the distribution of coarse powder in the metallic-compound fine particles, the $D_{90}$ is preferably 6.0 μm or smaller, more preferably in the range of 0.10 to 4.0 μm.

Furthermore, in the particle diameter distribution of the metallic-compound fine particles, it is preferable that extremely small particles are few in number. In the volume-based particle diameter distribution of the metallic-compound fine particles, the 10% particle diameter $D_{10}$ can be used as an index of the distribution of the fine powder. In the present invention, the $D_{10}$ of the metallic-compound fine particles is preferably 0.3 μm or larger, more preferably 0.4 μm or larger.

The $D_{10}$, $D_{50}$, and $D_{90}$ of the metallic-compound fine particles are measured as follows.

For instance, a liquid module is attached to a laser-diffractive particle diameter distribution analyzer "LS-230" (manufactured by Coulter Inc.). A particle diameter of 0.04 to 2000 μm is defined as a measuring range, and the volume-based particle diameter distribution is measured. From the results of the volume-based distribution, $D_{10}$, $D_{50}$, and $D_{90}$ of the particles are calculated. The measurement is performed under the conditions in which the measuring time is 90 seconds and the measurement is performed only once after adding about 10 mg of the metallic-compound fine particles in 10 ml of methanol and dispersing the particles for 2 minutes using an ultrasonic dispersing device.

A preferable volume resistivity of the metallic-compound fine particles used in the present invention is in the range of $1\times10^{-1}$ to $1\times10^{9}$ Ωcm. When the volume resistivity of the metallic-compound fine particles exceeds $1\times10^{9}$ Ωcm and such particles are used in the image forming method containing the step of contact charging, the effect of improving the charging property is low in the step of charging. On the other hand, when the volume resistivity of the metallic-compound fine particles is less than $10\times10^{-1}$ Ωcm, the frictional charging characteristics of the toner under high humidity can be inhibited to lower the development performance. In this case, furthermore, fogging is likely to occur and the transfer efficiency can be decreased while the contamination of charging member in the development-cleaning system is also likely to occur. Therefore, the effect of improving the charging property achieved by an increase in the specific surface area of the metallic-compound fine particles can be lowered. The volume resistivity of the metallic-compound fine particles is more preferably in the range of $1\times10^{-1}$ to $1\times10^{6}$ Ωcm.

The volume resistivity of the metallic-compound fine particles is measured as follows.

The sample is filled in a metallic cell in the shape of a cylinder and upper and lower electrodes are arranged so as to be brought into contact with the sample. A load of 686 kPa (7 kgf/cm$^2$) is applied onto the upper electrode. Under such conditions, the voltage V is applied between the electrodes and simultaneously therewith the resistance of the metallic-compound fine particles (volume resistivity, RV) is measured with a current I (A) passing through the electrodes. At this time, the resistivity RV can be obtained using the following equation, where S denotes the area (cm$^2$) of the electrode and M denotes the thickness (cm) of the sample.

$$RV(\Omega\text{cm})=100\text{V}\times S(\text{cm}^2)/1(A)/M(\text{cm})$$

In this invention, the measurement is performed under the conditions in which the contact area between the electrodes and the sample is defined to 2.26 cm$^2$ and the voltage V is defined to 100 V.

The metallic-compound fine particles to be used in the present invention are conductive fine particles. The conductive metallic-compound fine particles include conductive fine powders of: metallic fine powder such as copper, gold, silver, aluminum, or nickel; metallic oxide such as zinc oxide, titanium oxide, tin oxide, aluminum oxide, indium oxide, silicon oxide, magnesium oxide, barium oxide, molybdenum oxide, iron monoxide, or tungsten oxide; and a metallic compound such as molybdenum sulfide, cadmium sulfide, or potassium titanate; or mixed oxide thereof.

Of those, preferable metallic-compound fine particles may be those containing at least one oxide selected from the group consisting of zinc oxide, tin oxide, and titanium oxide because of their adjustable resistivity, white or pale color, and unremarkable fogging that occurs when the metallic-compound fine particles are transferred on the transfer material.

In addition, for controlling the resistivity of the metallic-compound fine particles, fine particles of metallic oxide that contains elements such as antimony or aluminum, and the fine particles having conductive materials on their surfaces may be used as the metallic-compound fine particles. Specifically, for instance, such particles may be zinc oxide fine particles containing elemental aluminum or tin oxide fine particles containing elemental antimony. However, controlling the resistance of the metallic-compound fine particles with the introduction of elemental antimony is generally not preferable because of an increase in the black-and-blue color of the powder.

In the case of combining a direct injection charging mechanism and a cleanerless system in the method for forming an image, there is used an organic photoconductor containing a conductive tin oxide as an injection charge trapping agent in a surface protective layer of the photoconductor. In this case, when the metallic-compound fine particles presented on an abutting portion between a photoconductor and a charging member contain tin oxide, a satisfactory direct-injection charging property is obtained. It is considered that the charge transfer from the metallic-compound fine particles to the trapping agent on the surface of photoconductor is faster between identical elements than the charge transfer between different elements because the former has few barriers compared with the latter. Therefore it is preferable that the metallic-compound fine particles contain at least tin oxide and its content is preferably larger. However, the metallic-compound fine particles containing typical tin oxide almost 100% by mass is insufficient with respect to the resistant control. Also, the reduction-treatment type tin oxide, which enables one to make the rate of the direct injection charging high, having a light color taste and capable of an appropriate resistant control, may be preferably used as the metallic-compound fine particles.

The tin oxide subjected to the reduction treatment is described in JP 6-345429 A. For improving the characteristics of the metallic-compound fine particles under high humidity, it is preferable to use these particles after subjecting them to an appropriate surface treatment. When the metallic-compound fine particles take up moisture, the following problems tend to be occurred. That is, (i) the image quality deteriorates due to lowering of the effect of improving the frictional charging characteristics of the toner, and (ii) the particles are likely to be detached from a charging member, to thereby lower the effect of frictional charging characteristics of the toner. As an agent for treating the surfaces of the metallic-compound fine particles, a silicon compound is preferable because of its high water repellency. In terms of improving the frictional charging characteristics of the toner, it is preferable that the metallic-compound fine particles provide the toner with frictional charging property having a polarity reverse to that of the toner particles. For instance, when the metallic-compound fine particles are added to the negatively charged toner particles, the characteristics thereof can be considerably improved by subjecting the metallic-compound fine particles to a surface treatment with a silicon compound containing a nitrogen element.

It is preferable to externally add 0.5 to 3.0 parts by mass of the metallic-compound fine particles with respect to 100 parts by mass of the toner particles.

It is more preferable to consider the specific gravity of the toner for determining the content of the metallic-compound fine particles in the toner of the present invention. When the specific gravity of the toner is high, the appropriate content becomes small as the surface area of the toner per unit weight becomes small. When the specific gravity of the toner is small, on the other hand, the appropriate content increases. The appropriate content and the specific gravity of the toner are almost in inverse proportion to each other, and preferably the product between values of both of them is within a certain range. When the content of the metallic-compound fine particles for the toner is defined as X (wt %) and the specific gravity of the toner is defined as Y (g/cm$^3$), it is preferable to satisfy the following relationship:

$$0.5<X\times Y<6.0.$$

If $X\times Y<0.5$, the content of the metallic-compound fine particles is low so that a sufficient effect of the addition is hardly obtained. On the other hand, if $0.6<X\times Y$, it is not preferable because the amount of the metallic-compound fine particles that exist between the toner particles is too large and there is a tendency to decrease the floodability index of the toner described below.

Preferably, in the toner of the present invention, there is added inorganic fine powder having an average primary particle diameter in the range of 4 to 80 mm as a flow improver and a transfer auxiliary agent. The inorganic fine powder is added for improving the flowability of the toner, equalizing the amount of frictional charge, and improving transfer efficiency. The addition of functions for adjusting the frictional charge amount of the toner and improving the environmental stability by subjecting the inorganic fine powder to hydrophobic treatment may be also a preferred embodiment.

When the average primary particle diameter of the inorganic fine powder is larger than 80 nm, the image density tends to be decreased so that a satisfactory image is hardly obtained in a stable manner. In this case, furthermore, the flowability of the toner deteriorates, and also non-uniform charging of the toner particles readily occurs. Therefore, there is a tendency for an increase in fogging to occur and for an increase in the amount of the toner remained on an image bearing member after the transfer to occur. In this case, furthermore, as described below, the floodability index of the toner is rather low. In a cleanerless system, the charging member tends to be contaminated, so that there is less effect of improving the charging property of the toner even though the metallic-compound fine particles are used. On the other hand, the cohesiveness of the inorganic fine powder increases when the average primary particle diameter of the inorganic fine powder is less than 4 nm. In this case, therefore, it is difficult to break the cohesion even with a crush treatment, so that inorganic fine powder tends to behave like an aggregate having a strong cohesiveness with a wide particle diameter distribution. As a result, the aggregate damages the image bearing member or the toner carrying member, so that defects in an image can be easily generated. For providing toner particles with a more uniform triboelectric charge distribution, the average primary particle diameter of inorganic fine powder may be more preferably in the range of 6 to 70 nm.

According to the present invention, the method for measuring the average primary particle diameter of the inorganic fine powder is as follows. That is, a comparison between a photograph of the toner scaled up 50,000 times taken by a scanning electron microscope and a photograph of the toner mapped with elements contained in the inorganic fine powder by element-analyzing means, such as XMA attached on the scanning electron microscope, is performed. Then, 100 or more primary particles of the inorganic fine powder, which are being attached on the surfaces of the toner particles or are being liberated therefrom, are measured to obtain the average primary particle diameter of the inorganic fine powder as the number-average particle diameter of these particles.

The inorganic fine powders to be used in the present invention include silica, alumina, titanium oxide, or mixed oxide thereof.

For instance, silica to be used in the present invention may be one of two types of silica, one being dry-process silica generated by vapor-phase oxidation of silicon halide, referred as dry silica or fumed silica, and the other being wet silica manufactured from water glass. However, it is preferable to use dry silica because the number of silanol groups on the surface and in the inside of silica particle and the quantity of residues in the manufacturing of $Na_2O$ and $SO^{3-}$ are small, compared with those of wet silica. Furthermore, for example, dry silica allows the production of mixed fine powder of silica and another metallic oxide by use of silica halide together with metallic halide, such as aluminum chloride or titanium chloride, in the manufacturing process.

The addition amount of the inorganic fine powder may be preferably in the range of 0.1 to 3.0 parts by mass with respect to 100 parts by mass of the toner particles. When the addition amount of the inorganic fine powder is less than 0.1 parts by mass, the effect thereof is not sufficient. When it is more than 3.0 parts by mass, the fixing ability of the toner decreases.

It is preferable to subject the inorganic fine powder to hydrophobic treatment while considering the use of the toner under high temperature and humidity conditions. When the inorganic fine particles mixed with the toner particles take up moisture, the frictional charge amount of the toner decreases and thus the scattering of the toner becomes more prevalent.

A hydrophobic treatment agent may be selected from silicon varnish, various kinds of modified silicon varnish, silicon oil, various kinds of modified silicon oil, silane compounds, silane coupling agents, other organic silicon compounds, and organic titanium compounds, and may be used alone or in combination.

Of those, inorganic fine powder treated with silicon oil is preferable. In this case, more preferably, the inorganic fine powder may be treated with silicon oil simultaneously with or after the hydrophobic treatment with a silane compound because of the objective of keeping a high frictional charge amount of the toner even under high humidity and to prevent the toner from being scattered.

The conditions for the hydrophobic treatment on the inorganic fine powder are as follows. For instance, a hydrophobic thin film is formed on the surface of the powder with silicon oil in a second stage reaction after conducting sililation with the silane compound as a first stage reaction to clean up silanol groups by chemical bonding.

The above silicon oil may have a viscosity of preferably 10 to 200,000 $mm^2/s$, and more preferably 3,000 to 80,000 $mm^2/s$ at 25° C. When the viscosity thereof is less than 10 $mm^2/s$, the stability of the inorganic fine powder is low and there is a tendency to cause the deterioration of an image with thermal or mechanical stress. Furthermore, when the viscosity of the silicon oil exceeds 200,000 $mm^2/s$, there is a tendency for uniform treatment to be difficult to be conducted.

The silicon oils useful in this embodiment may include dimethyl silicon oil, methylphenyl silicon oil, α-methyl styrene modified silicon oil, chlorphenyl silicon oil, and fluorine modified silicon oil.

For instance, the method of treating of the inorganic fine particles with silicon oil may comprise directly mixing inorganic fine powder treated with a silane compound and silicon oil using a mixer such as a Henschel mixer, or the method may comprise spraying silicon oils on the inorganic fine powder.

The method of treating of the inorganic fine particles with silicon oil may be a method where silicon oil is dissolved or dispersed in an appropriate solvent and inorganic fine powder is added and mixed together, followed by removing the solvent from the mixture. It is preferable to use the spraying method from the viewpoint of relatively less generation of aggregates of the inorganic powder.

The amount of the silicon oil used for treating the inorganic fine particles may be 1 to 23 parts by mass, preferably 5 to 20 parts by mass with respect to 100 parts by mass of the inorganic fine particles. When the amount of the silicon oil is too small, a favorable hydrophobic property of the inorganic fine powder cannot be obtained. When the amount of the silicon oil is too high, fogging is likely to occur.

Next, the behavior of the toner attached on a charging member will be described.

When the toner is attached to the contact charging member, there is caused a problem in that the toner is fused on the charging member or the photoconductor is chipped off when the toner is being attached without being removed. Also, the surface of the charging member fused with the toner becomes highly resistant, with the result that even though it exerts an effect of keeping the charging property of the charging member to a certain degree by using the metallic-compound fine particles having large specific surface areas and many contacting points, the effect of the addition of the metallic-compound fine particles is decreased. More preferably, the adhesion between contaminated toner and the surface of the charging member may be weakened by vibrations generated when the contact charging member is actuated. In this case, the contaminated toner can be eliminated onto the photoconductor with the action of an electric field caused by the potential difference between the surface of the charging member and the photoconductor. To attain the state, it is preferable to use toner which is capable of smoothly shifting from the non-flowing state to the flowing state.

There are many methods for evaluating the flowability of the toner, which is one of the characteristics of the toner. Of those, there is the floodability index of Carr provided as an index for overall estimation of the flowability of the fine particles on the basis of data of several phenomena and characteristics to which the flowability are related.

The floodability index may be one index of the possibility of the occurrence of a flushing phenomenon. Here, the term "flushing" means that the fine particles whose flowability is decreased in the non-flowing state enters a fluid state like a liquid due to vibration and is fluidized. In other words, it means that the floodability of the toner powder increases as the level of the floodability index increases.

The floodability index of the toner powder is measured by the following method.

Using a powder tester P-100 (manufactured by Hosokawa Micron Co., Ltd.), each of parameters including the angle of rest, the decay angle, the angle of difference, the degree of compression, the degree of aggregation, the spatula angle, and the degree of dispersion are measured. The values obtained for each of the parameters are applied onto the table of the floodability index of Carr and are then converted into each of index values of 25 or less. The total of indexes obtained from the respective parameters is calculated as the flowability index and the floodability index. In the following, therefore, the method for measuring each of the above parameters will be described.

[Angle of Rest]

150 g of toner is accumulated on a circular table having a diameter of 8 cm through a mesh having a pore size of 710 μm. At this time, the toner is accumulated to a degree that it flows out of the end of the table. An angle formed between the ridgeline of the toner accumulated on the table and the surface of the circular table is measured with a laser beam to obtain an angle of rest.

[Degree of Compression]

A degree of compression can be obtained from loose-packing bulk density (loose apparent specific gravity A) and tapping bulk density (hard apparent specific gravity P) by the following equation.

$$\text{Compression degree}(\%)=100(P-A)/P$$

(1) Method for Measuring the Loose Apparent Specific Gravity

Toner (150 g) is poured gently into a measuring cup (5 cm in diameter, 5.2 cm in height, and 100 cc in volume). After filling and heaping the measuring cup with toner, the surface of the toner overflowing from the cup is cut by rubbing. Then, the loose apparent specific gravity of the toner is calculated from the amount of the toner filled in the cup.

(2) Method for Measuring the Hard Apparent Specific Gravity

The measuring cup used in the measurement of loose apparent specific gravity is extended with an accessory cap and is then filled with toner. Subsequently, the cup is tapped 180 times. After completing the tapping, the cap is removed and the excess part of the toner overflowing from the cup is cut by rubbing. From the amount of the toner that fills the cup, the hard apparent density is calculated Both the apparent specific gravity values are substituted in the above-mentioned equation to calculate the degree of compression.

[Spatula Angle]

A vat (10 cm×15 cm) is placed such that the bottom of the vat is brought into contact with a spatula (3 cm×8 cm). Then, toner is accumulated on the spatula. At this time, the toner should be heaped up on the spatula. Subsequently, only the vat is moved down gently, followed by measuring the inclination angle of the side face of toner that remained on the spatula by means of a laser beam. After that, the toner is given a shock on the vat by a shocker attached on the spatula, followed by measuring the spatula angle again. A mean value of this measuring value and the measuring value before applying the shock is calculated as a spatula angle.

[Degree of Aggregation]

Filters of 75, 150, and 250 μm in pore size are arranged on a vibrating table in the stated order. Then, the toner (5 g) was placed gently on the vibration table and was then shaken under the conditions of a vibration amplitude of 1 mm and a vibration time period of 20 seconds. After terminating the vibration, the weight of the toner that remained in each of the filters was measured. Then, the following calculations are conducted.

$$[(\text{Weight of toner remained on the upper filter})/5\text{ g}]\times 100 \quad a$$

$$[(\text{Weight of toner remained on the middle filter})/5\text{ g}]\times 100\times 0.6 \quad b$$

$$[(\text{Weight of toner remained on the lower filter})/5\text{ g}]\times 100\times 0.2 \quad c$$

From the above equations, the values a, b, and c are obtained, respectively. Then, the degree of aggregation is calculated using the following equation.

$$a+b+c=\text{Degree of Aggregation}(\%)$$

Each of the values obtained from the parameters is applied onto the table of flowability index of Carr and the floodability index (see Chemical Engineering. Jan. 18, 1965) and is then converted into an index of 25 or less. Consequently, the Carr's flowability index is obtained by summing up the resulting index values as follows.

$$(\text{Rest angle})+(\text{Compression degree})+(\text{Spatula angle})+(\text{Aggregation degree})=(\text{Carr's flowability index})$$

[Decay Angle]

After measuring the rest angle, three shocks are applied onto the vat placed on the circular table by the shocker. Subsequently, the angle of the toner remaining on the table is measured using a laser beam and is then referred to as a decay angle.

[Angle of Difference]

The difference between the rest angle and the decay angle is referred to as the angle of difference.

[Degree of Dispersion]

A mass of toner (10 g) is dropped down from about 60 cm height to the surface of a watch glass of 10 cm in diameter. Then, the amount of toner remaining on the watch glass is measured and is then substituted into the following equation to obtain the degree of dispersion.

$$\text{Dispersion degree }(\%)=((10-(\text{the amount of toner remaining on the watch glass}))\times 10$$

The sum of the index that can be converted from each value of the decay angle, the angle of difference, and the degree of dispersion and the index on which the flowability index value calculated as described above can be obtained as a foodability index from the table of Carr described above.

As a result of this measurement, when the toner is of good foodability in which the foodability index measured as above is larger than 80, the effect of maintaining the charging property of the metallic-compound fine particles can be sufficiently exerted because the fusion of toner on the charging member hardly occurs even in a cleanerless system having the step of contact charging.

In the case of having a foodability index or 80 or less, the toner hardly flows when several toner layers are laminated on the surface of the charging member even though any force is applied. In this case, therefore, the toner is fused when the use of a printer is continued, so that it becomes difficult to maintain the charging property of the toner.

For attaining a favorable foodability index of the toner, the particle diameter of a flow improver to be added in the toner, and the processing conditions (e.g., mixing time) of a mixing apparatus to be used at the time of addition may be altered to change the foodability index.

The apparatus for the process of external addition may be, for example, a Herschel mixer (manufactured by Mitsui Mining Co., Ltd.), a super mixer (manufactured by Kawata Mfg. Co., Ltd.), a conical ribbon mixer "Riboconne" (manufactured by Okawara MFG. Co., Ltd.), a Nauta mixer, a Turbuler mixer, and a Cycromix (manufactured by Hosokawamicron Co., Ltd.), a spiral pin mixer (Pacific Machinery & Engineering Co., Ltd.), or a Redige mixer (manufactured Matsubo Co., Ltd.).

Here, a description will be provided of the toner of the present invention in more detail.

In terms of preservability, a binder resin included in the toner particles may have a glass transition temperature (Tg) of 45 to 80° C., and preferably 50 to 70° C. When the Tg is lower than 45° C., the toner tends to deteriorate in a high-temperature atmosphere and offset tends to be generated at the time of fixation. When the Tg is higher than 80° C., on the other hand, there is a tendency for the fixing ability to decrease.

To measure the glass transition temperature of the binder resin, a differential thermal analyzer (DSC measuring apparatus), a DSC-7 (manufactured by Perkin Elmer Co., Ltd.), EXSTAR6000, SSC/5200 (manufactured by Seiko Instruments Inc.), or a DSC2920MDSC (manufactured by TA Instruments Inc.) may be used. The measurement can be conducted under the following conditions.

[Method of Measuring the Glass Transition Temperature of Resin]

Sample: 0.5 to 2 mg, preferably 1 mg

Temperature curves:

heating-up I (20° C. to 180° C., heating-up rate 10° C./min.);

cooling-down I (180° C. to 10° C., cooling-down rate 10° C./min.); and heating-up II (10° C. to 180° C., heating-up rate 10° C./min.).

Measuring procedures: The sample is placed in an aluminum pan, while an empty aluminum pan is used as a reference. A point of intersection of a line on the middle point of the base lines before and after the generation of an endothermic peak and a differential thermal curve is defined as a glass transition point Tg.

Preferably, each of the binder resins which can be used in the present invention may have a number-average molecular weight (Mn) of 3,000 to 20,000 and a weight-average molecular weight (Mw) of 50,000 to 500,000 in accordance with the molecular weight of a THF soluble component measured by GPC. In those ranges, the fixing ability and the durability thereof are kept in good balance with respect to each other.

The binder resin may be mixed and dispersed with wax component in advance at the time of preparing the toner. Such a preliminary mixing of the wax component allows an excellent state of dispersion as the phase separation in a micro region is relieved.

In the present invention, the molecular distribution of the toner or binder resin by GPC using tetrahydrofuran (THF) is measured under the following conditions.

A column is stabilized in a chamber heated at a temperature of 40° C. Then, THF is provided as a solvent and passed through the column at a flow rate of 1 ml/min. at 40° C. 100 μl of a sample in THF solution is injected into the column and then the measurement is conducted. For measuring the molecular weight of the sample, the molecular weight distribution of the sample is calculated from the relationship between the logarithmic value of a calibration curve obtained from a monodisperse polystyrene standard sample and the count number. The polystyrene standard sample for forming a calibration curve may be one having a molecular weight of about $10^2$ to $10^7$, manufactured by Tosoh Corporation, Showa Denko K.K., or the like. Appropriately, at least about 10 standard polystyrene samples may be used. For the detection, a refractive index (RI) detector is used. The column may be a combination of two or more polystyrene gel columns, which are commercially available. For instance, the column may be a combination of Shodex GPC KF-801, 802, 803, 804, 805, 806, 807, and 800P, commercially available from Showa Denko K.K., and TSK gel G1000H (HXL), G2000H (HXL), G3000H (HXL), G4000H (HXL), G5000H (HXL), G6000H (HXL), G7000H(HXL), and TSK guard column, commercially available from Tosoh Corporation.

Each sample used for measurement of the molecular distribution is prepared as follows.

A sample is placed in THF and left therein for several hours, followed by shaking sufficiently to mix the sample with the THF well (until a cluster of the sample disappears) and leaving the mixture at rest for 12 hours or longer. In this case, the sample is let stand in the THF for 24 hours or longer. Subsequently, the mixture is passed through a sample-processing filter (0.45 to 0.5 μm in pore size, e.g., Myshori-Disk H-25-5 manufactured by Tosoh Corporation, or Ekikuro-Disk 25R Gelman Science Japan. Co., Ltd., and so on) and is then referred to as a measuring sample of GPC. The concentration of the sample is adjusted such that the content of resin component is in the range of 0.5 to 5 mg/ml.

The binder resins to be useful in the present invention include styrene resin, styrene copolymer resin, polyester resin, polyol resin, polyvinyl chloride resin, phenol resin, naturally denatured phenol resin, natural resin denatured maleic resin, acrylic resin, methacrylic resin, polyvinyl acetate resin, silicon resin, polyurethane resin, polyamide resin, furan resin, epoxy resin, xylene resin, polyvinyl butyral, terpene resin, coumarone-indene resin, petroleum resin, and so on.

Comonomers for styrene monomer of the styrene copolymer include styrene derivatives such as vinyl toluene; acrylic acid; acryl esters such as methyl acrylate, ethyl acrylate, butyl acrylate, dodecil acrylate, octyl acrylate, 2-etylhexyl acrylate, and phenyl acrylate; methacrylate; methacrylate esters such as methyl methacrylate, ethyl methacrylate, butyl methacrylate, and octyl methacrylate; maleic acid; dicarboxylate esters having double bonds such as butyl maleate, methyl maleate, and dimethyl maleate; acrylamide, acrylonitrile, methacrylonitrile, butadiene; vinyl chloride; vinyl esters such as vinyl acetate and vinyl benzoate; ethylene olefin such as ethylene, propylene and butylene; vinyl ketones such as vinylmethyl ketone and vinylhexyl ketone; and vinyl ethers such as vinylmethyl ether, vinylethyl ether, and vinylisobutyl ether. These vinyl monomers may be used in isolation or in combination.

It is preferable that the binder resin of the present invention has an acid value preferably in the range of 1 to 70 mg KOH/g. More preferably, it is a resin having an acid value of 2 to 50 mg KOH/g. When the acid value is larger than 70 mg KOH/g, the frictional charge amount decreases under high humidity conditions. When the acid value is smaller than 1 mg KOH/g, the frictional charging rate decreases under a low humidity environment.

Monomers capable of adjusting the acid value of the binder resin include, for example, acrylic acids and α- or β-alkyl derivatives thereof, such as acrylic acid, methacrylic acid, α-ethyl acrylic acid, crotonic acid, cinnamic acid, vinyl acetic acid, isocrotonic acid, and angelic acid; and unsaturated dicarboxylates and monoester derivatives or anhydrates thereof, such as fumaric acid, maleic acid, citraconic acid, alkenyl succinic acid, itaconic acid, mesaconic acid, dimethyl maleic acid, and dimethyl fumaric acid. Those monomers may be used in isolation or in combination to prepare a mixture thereof for providing a desired copolymer by copolymerizing with other monomer. Of those, in particular, it is preferable to use the monoester derivative of unsaturated dicarboxylate for controlling the acid value.

For instance, those monomers include monoesters of α- and β-unsaturated dicarboxylates such as monomethyl maleate, monoethyl maleate, monobutyl maleate, monooctyl maleate, monoallyl maleate, monophenyl maleate, monomethyl fumarate, monoethyl fumarate, monobutyl fumarate, and monophenyl fumarate; monoesters of alkenyl dicarboxylates such as n-butenyl monobutyl succinate, n-octenyl monomethyl succinate, n-butynyl monoethyl malonate, n-dodecenyl monomethyl glutarate, and n-butenyl monobutyl adipate.

Each of those monomers may be used at a concentration of 0.1 to 20 parts by mass, and preferably 0.2 to 15 parts by mass with respect to 100 parts by mass of the total monomers that constitute the binder resin.

The polymerization methods that are useful as a synthetic method of producing the binder resin include a solution polymerization method, an emulsion polymerization method, and a suspension polymerization method.

Of those, the emulsion polymerization method disperses monomer substantially insoluble in water as small particles using an emulsifier into a water phase, followed by performing the polymerization using a water-soluble polymerization initiator. This method facilitates the adjustment of the reaction heat, and the speed of terminating the reaction is slow as the phase in which the polymerization is progressed (i.e., the oil phase comprised of polymer and monomer) and the aqueous phase are different. As a result, in this method, the rate of polymerization is great and a polymer having a high degree of polymerization can be obtained. Furthermore, the polymerization process is comparatively simple and the polymerization product is fine particles, so that there are advantages in terms of the method for manufacturing the binder resin because those fine particles can be easily mixed with colorant, a charge-controlling agent, and other additives.

However, the resulting polymer tends to contain impurities due to the emulsifier being added, so that there is a need for salting-out for taking out the polymer. For avoiding such an inconvenience, suspension polymerization is preferable.

The suspension polymerization may be conducted using 100 parts by mass or less, and preferably 10 to 90 parts by mass of monomer with respect to 100 parts by mass of water solvent. As a dispersing agent, polyvinyl alcohol, a partially saponificated product of polyvinyl alcohol, calcium phosphate, or the like may be used. In general, such a dispersing agent may be used at a concentration of 0.05 to 1 part by mass with respect of 100 parts by mass of water solvent. An appropriate temperature of the polymerization is in the range of 50 to 95° C., but not limited to such a range. Alternatively, it may be appropriately selected depending on the polymerization initiator to be used and an objective polymer.

The binder resin to be used in the present invention may be preferably prepared using a polyfunctional polymerization initiator in isolation or in combination with a monofunctional polymerization initiator given below.

The polyfunctional polymerization initiators having polyfunctional structures include polyfunctional polymerization initiators having two or more peroxide groups per molecule such as 1,1-di-t-butylperoxy-3,3,5-trimethylcyclohexane, 1,3-bis-(t-butylperoxyisopropyl)benzene, 2,5-dimethyl-2,5-(t-butylperoxy)hexane, 2,5-dimethyl-2,5-di-(t-butylperoxy)hexane, tris-(t-butylperoxy)triazine, 1,1-di-t-butylperoxycyclohexane, 2,2-di-t-butylperoxybutane, 4,4-di-t-butylperoxy valeric acid-n-butylester, di-t-butylperoxyhexahydroterephtharate, di-t-butylperoxyazelate, butyperoxytrimethyladipate, 2,2-bis-(4,4-di-t-butylperoxycyclohexyl)propane, 2,2-t-butylperoxyoctane, and various kinds of polymer oxides; and polyfunctional polymerization initiators having both functional groups having polymerization-initiating functions such as a peroxide group and polymerizable unsaturated groups per molecule, such as diallyl peroxydecarbonate, t-butyl peroxymalate, t-butylperoxy allylcarbonate, and t-butylperoxy isopropylfumarate.

Of those, more preferred are 1,1-di-t-butylperoxy-3,3,5-trimethylcyclohexane, 1,1-di-t-butylperoxycyclohexane, di-t-butylperoxyhexahydroterephthalate, di-t-butylperoxyazelate and 2,2-bis-(4,4-di-t-butylperoxycyclohexyl)propane, and t-butylperoxyallylcarbonate.

Each of those polyfunctional polymerization initiators, for satisfying various kinds of performances required for the binder resin, may be preferably used in combination with a monofunctional polymerization initiator. In particular, it is preferable to use it in combination with a monofunctional polymerization initiator having a decomposition temperature which is lower than a decomposition temperature required for obtaining a half life of 10 hours of the polymerization initiator.

Specifically, the monofunctional polymerization initiators include: organic peroxides such as benzoyl peroxide, 1,1-di(t-butylperoxy)-3,3,5-trimethylcyclohexane, n-butyl-4,4-di(t-butylperoxy)valerate, dicumyl peroxide, α, α'-bis (t-butylperoxydiisopropyl)benzene, t-butylperoxycumene, and di-t-butyl peroxide; and azo- and diazo-compounds such as azobisisobutyronitrile, and diazoaminoazobenzene.

Each of those monofunctional polymerization initiators may be added in the monomer simultaneously with the addition of polyfunctional polymerization initiator. For appropriately maintaining the efficiency of the polyfunctional polymerization initiator, such an initiator may be preferably added in the step of polymerization after the lapse of its half life.

The polymerization initiator may be preferably used at a concentration of 0.05 to 2 parts by mass with respect to 100 parts by mass of monomer in terms of its efficiency.

The binder resin may be preferably cross-linked with a crosslinking monomer.

As the crosslinking monomer, a monomer that has two or more polymerizable double bonds is mainly used. Specific examples thereof include: aromatic divinyl compounds (for example, divinylbenzene, divinylnaphthalene, etc.); diacrylate compounds bonded together with an alkyl chain (for example, ethylene glycol diacrylate, 1,3-butylene glycol diacrylate, 1,4-butanediol diacrylate, 1,5-pentanediol diacrylate, 1,6-hexanediol diacrylate, neopentyl glycol diacrylate, and those obtained by changing the "acrylate" of the aforementioned compounds to "methacrylate"); diacrylate compounds bonded together with an alkyl chain containing an ether bond (for example, diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and those obtained by changing the "acrylate" of the aforementioned compounds to "methacrylate"); diacrylate compounds bonded together with a chain containing an aromatic group and an ether bond (for example, polyoxyethylene(2)-2,2-bis(4-hydroxyphenyl)propane diacrylate, polyoxyethylene(4)-2,2-bis(4-hydroxyphenyl)propane diacrylate, and those obtained by changing the "acrylate" of the aforementioned compound to "methacrylate"); and in addition, polyester-type diacrylate compounds (for example, MANDA (trade name) manufactured by Nippon Kayaku Co., Ltd.). The polyfunctional crosslinking monomer include: pentaerythritol acrylate, trimethylolethane triacrylate, trimethylolpropane triacrylate, tetramethylolpropane triacrylate, tetramethylolmethane tetraacrylate, oligoester acrylate and those obtained by changing the "acrylate" of the aforementioned compounds to "methacrylate"; and triallyl cyanurate and triallyl trimellitate.

Each of those crosslinking monomers may be used at a concentration of 0.00001 to 1 part by mass, preferably 0.001 to 0.05 parts by mass with respect to 100 parts by mass of other monomer components.

Of those crosslinking monomers, an aromatic divinyl compound (particularly, divinyl benzene) and diacrylate compounds linked with aromatic groups and ether bonds are preferably used in terms of the fixing ability and offset-resisting ability of toner.

Furthermore, other useful synthetic methods of the binder resin include a block polymerization method and a solution polymerization method. In the block polymerization method, a polymer having a low molecular weight can be obtained by increasing the termination reaction rate with the polymerization at an elevated temperature. In this case, however, there is a problem in which the reaction is difficult to be controlled. In that respect, on the other hand, the solution polymerization method is preferable because a polymer having a desired molecular weight can be easily obtained under mild conditions by the use of the difference in chain transfers of radicals with the solvent and by adjusting the amount of the polymerization initiator and the reaction temperature. In particular, the solution polymerization method is also preferable in that the usage amount of the polymerization initiator is kept to a minimum to suppress the effect of the residual initiator as much as possible.

The monomers of polyester resins useful in the present invention include the following compounds.

Divalent alcohol components include ethylene glycol, propylene glycol, 1,3-butanediol, 1,4-butanediol, 2,3-butanediol, diethylene glycol, triethylene glycol, 1,5-pentane diol, 1,6-hexane diol, neopentyl glycol, 2-ethyl-1,3-hexane diol, hydrogenarated bisphenol A, and bisphenol represented by the following formula (E) and derivatives thereof:

(E)

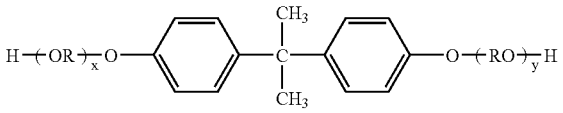

(wherein R is an ethylene or propylene group, each of x and y is an integer number of 0 or more, and the mean value of x+y is 0 to 10), or diols represented by the following formula (F);

(F)

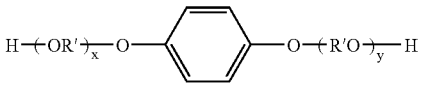

(wherein R' is —$CH_2CH_3$— or —$CH_2$—$CH(CH_3)$— or —$CH_2$—$C(CH_3)_2$—, each of x' and y' is an integer number of 0 or more, and the mean value of x'+y' is 0 to 10).

Divalent acid components include; benzene dicarboxylates such as phthalic acid, terephthalic acid, isophthalic acid, and phthalic anhydride, or anhydrates thereof or lower alkyl esters thereof; alkyldicarboxylic acids such as succinic acid, adipic acid, sebacic acid, and azelaic acid, or anhydrates thereof or lower alkyl esters thereof; alkenyl succinic acids or alkyl succinic acids, such as n-dodecenylsuccinic acid and n-dodecylsuccinic acid, or hydrates thereof or lower alkyl esters thereof; unsaturated dicarbocylates such as fumaric acid, maleic acid, citraconic acid, and itaconic acid, or hydrates thereof or lower alkyl esters thereof.

It is preferable to use an alcohol component with a valency of 3 or more or an acid component with a valency of three or more to act as a crosslinking component.

The polyhydric alcohol component that is trivalent or more includes: sorbitol; 1,2,3,6-hexanetetrol; 1,4-sorbitan; pentaerythritol; dipentaerythritol; tripentaerythritol; 1,2,4-butanetriol; 1,2,5-pentanetriol; glycerol; 2-methylpropanetriol;

2-methyl-1,2,4-butanetriol; trimethylolethane; trimethylolpropane; and 1,3,5-trihydroxybenzene.

Polyvalent carboxylic acid component with a valency of 3 or more may be selected from trimellic acid, pyromellitic acid, 1,2,4-benzene tricarboxylic acid, 1,2,5-benzen tricarboxylic acid, 2,5,7-naphthalene tricarbocylic acid, 1,2,4-naphthalene tricarbocylic acid, 1,2,4-butane tricarboxylic acid, 1,2,5-hexane tricarboxylic acid, 1,3-dicarboxyl-2-methyl-2-methylene carboxylpropane, tetra(methylene carboxyl)methane, 1,2,7,8-octane tetracarboxylic acid, empoltrimeric acid, or anhydrides thereof and lower alkyl esters thereof; tetracarboxylic acids represented by the following formula (G):

(G)

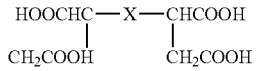

(wherein X is an alkylene group or an alkenylene group having a carbon number of 5 to 30 and having one or more side chains with a carbon number of 3 or more), or anhydrides thereof or lower alkyl esters thereof. Preferably, the content of the alcohol component is 40 to 60% by mole, more preferably 45 to 55% by mole, and the content of the acid component is 60 to 40% by mole, more preferably 55 to 45% by mole. In addition, preferably, the polyvalent component with a valency of 3 or more is 5 to 60% by mole in the total components.

The polyester resin is also obtained by condensation polymerization well known in the art.

The wax to be used in the present invention include, for example, aliphatic hydrocarbon wax such as lower molecular weight polyethylene, low molecular weight polypropylene, polyolefin copolymer, polyolefin wax, microcrystalline wax, paraffin wax, and Fisher Trop push wax; oxides of aliphatic hydrocarbon wax such as oxidized polyethylene wax, or block copolymer products thereof; plant wax such as candelilla wax, carnauba wax, Japan tallow, and jojoba wax; animal wax such as bees wax, lanolin, and spermaceti wax; mineral wax such as ozokerite, ceresin, and petrolatum; wax mainly containing aliphatic ester, such as montanic acid ester wax and caster wax; and partially or totally deoxidized aliphatic esters such as deoxidized carnauba wax. Furthermore, saturated straight-chain fatty acids such as palmitic acid, stearic acid, montanonic acid, and long-chain alkyl carboxylic acids having a long-chain alkyl group; unsaturated fatty acids such as brassidic acid, eleostearic acid, and varinaline acid; saturated alcohols such as stearic alcohol, eicosyl alcohol, behenyl alcohol, cownabil alcohol, ceryl alcohol, melissyl alcohol, or alkyl alcohol having a long-chain alkyl group; polyvalent alcohols such as sorbitol; aliphatic amides such as linoleic amide, oleic amide, and lauric amide; saturated aliphatic bisamides such as methylene bis-stearic amide, ethylene bis-capric amide, ethylene bis-laurylic acid, and hexamethylene bis-stearic amide; unsaturated aliphatic amides such as ethylene bis-oleinic amide, hexamethylene bis-oleinic amide, N,N'-dioleyl adipinic amide, and N,N'-dioleyl sebacic amide; aromatic bisamide such as m-xylene bis-stearic amide and N,N'-distearic isophthalic amide; aliphatic metallic salts (generally referred to as metal soap) such as calcium stearate, calcium laurate, zinc stearate, and magnesium stearate; wax obtained by grafting aliphatic hydrocarbon wax using vinyl monomers such as stylene or acrylic acid; partially esterified product of fatty acid such as monoglyceride behenic acid and polyalcohol; and methyl ester compound having a hydroxyl group obtained by the hydrogenation of vegetable oil.

Each of the above wax products is preferably one subjected to a press sweating, solvent process, recrystallization, vacuum evaporation, supercritical gas extraction, or melt crystalline precipitation to make the molecular weight distribution thereof sharp, or one from which low molecular weight solid fatty acid, low molecular weight solid alcohol, low molecular weight solid compound, and other impurities are removed.

The colorant to be used in the present invention may be magnetic iron oxide. In this case, the toner of the present invention can be used as a magnetic toner. The magnetic iron oxide may be preferably one that contains a non-iron element on the surface or in the inside thereof. For instance, the magnetic iron oxide is magnetite, maghemite, or ferrite having a non-iron element on the surface or in the inside thereof.

When the toner of the present invention is the magnetic toner, magnetic iron oxide may include preferably 0.05 to 10, more preferably 0.1 to 5 percent by mass of the non-iron element with iron as a standard element.

Furthermore, the above magnetic iron oxide may be preferably contained at a concentration of 20 to 200 parts by mass with respect to 100 parts by mass of the binder resin. More preferably, 50 to 120 parts by mass of the magnetic iron oxide may be included.

The non-iron element is preferably an element selected from magnesium, aluminum, silicon, phosphorus, and sulfur. In addition, metals such as lithium, beryllium, boron, germanium, titanium, zirconium, tin, lead, zinc, calcium, barium, scandium, vanadium, chromium, manganese, cobalt, copper, nickel, gallium, cadmium, indium, silver, palladium, gold, mercury, platinum, tungsten, molybdenum, niobium, osmium, strontium, yttrium, and technetium, may also be mentioned.

The number-average particle diameter of the above magnetic iron oxide may be preferably in the range of 0.05 to 1.0 μm, more preferably 0.1 to 0.5 μm. It is preferable to use magnetic iron oxide having a BET specific surface area of 2 to 40 $m^2/g$ (more preferably, 4 to 20 $m^2/g$). The shape of magnetic iron oxide is not specifically limited, so that any shape thereof may be allowed to be used. Furthermore, under a magnetic field of 795.8 kA/m, the magnetic properties of the above magnetic iron oxide include a saturation magnetization of 10 to 200 $Am^2/kg$ (more preferably, 70 to 100 $Am^2/kg$), a residual magnetization of 1 to 100 $Am^2/kg$ (more preferably, 2 to 20 $Am^2/kg$), and an anti-magnetic force of 1 to 30 kA/m (more preferably, 2 to 15 kA/m).

Furthermore, a preferable magnetic toner is one having a density of 1.3 to 2.2 $g/cm^3$, and more preferably 1.5 to 2.0 $g/cm^3$. The mass (density) of the magnetic toner correlates with the actions of magnetic force, electrostatic force, and gravity to be acted on the magnetic toner particles. The magnetic iron oxide exhibits desirable actions when the density of the magnetic toner is in the above range, so that there is a good balance between the charging and the magnetic force to provide an excellent developing ability.

Furthermore, the magnetic iron oxide acts insufficiently on the magnetic toner when the density of the magnetic toner is less than 1.3 $g/cm^3$, so that the magnetic force of the toner is decreased. As a result, the electrostatic force for transferring the toner particles from toner carrying member to the image bearing member becomes stronger than the magnetic force for holding the toner particles on the toner carrying member, at the time of developing procedure, which can lead to a state of excess development. Such a state leads to an increase in the fogging and the amount of toner consumption. In contrast, the action of magnetic iron oxide on the magnetic toner becomes strong when the density of the magnetic toner is higher than 2.2 $g/cm^3$, so that the magnetic force becomes stronger than the electrostatic force. In this case, the actions of magnetic force exerted on the toner become strong, and the specific gravity of the toner is also increased, so that it becomes difficult for the toner to fly out of the toner carrying member (such as a developing sleeve) at the time of developing procedure. Consequently, insufficient developing occurs, so that the image density tends to be thinned and the image tends to deteriorate.

The magnetic iron oxide to be used in the magnetic toner may be treated with a silane coupling agent, titanium coupling agent, titanate, or aminosilane.

Preferably, the toner of the present invention contains a charge-controlling agent.

The following compounds can be mentioned as those capable of providing the toner with an appropriate negative charging property.

That is, organic metal complexes and chelate compounds are effective, including a monoazo metal complex, an acetylacetone metal complex, and metal complexes of aromatic hydroxy carboxylic acid and aromatic dicarboxylic aid. Other compounds include aromatic hydroxy carboxylic acid, aromatic mono and polycarboxylic acids and metallic salts, anhydrides, and esters thereof, and a phenol derivative of bisphenol.

Of those, an azo-metal complex represented by the following formula (I) is preferable.

(I)

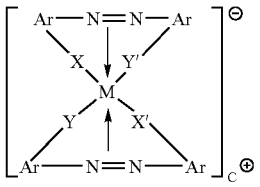

(wherein M denotes a metal in the center of a ligand, which is Sc, Ti, V, Cr, Co, Ni, Mn, or Fe; Ar denotes an aryl group, such as a phenyl group or a naphtyl group, which may have a substituent selected from a nitro group, a halogen group, a carboxyl group, an anilide group, an alkyl group having 1 to 18 carbon atoms, and an alkoxy group having 1 to 18 carbon atoms; and each of X, X', Y, and Y' is one selected from —O—, —CO—, —NH—, and —NR—® is an alkyl group having 1 to 4 carbon atoms). In the above formula (1), $C^+$ denotes a counter ion selected from hydrogen, sodium, potassium, ammonium, and aliphatic ammonium ions and mixtures thereof).

In particular, the central metal is preferably Fe or Cr, and the substituent is preferably halogen, an alkyl group, or an anilide group, and the counter ion is preferably hydrogen, sodium, potassium, ammonium, or aliphatic ammonium. The mixture of complex salts having different counter ions is also preferably used.

The following compounds can be mentioned as the charge-controlling agent capable of providing the toner with an appropriate positive charging property.

That is, such compounds include nigrosin and the products obtained by modifying nigrosin with aliphatic metal salt or the like; quaternary ammonium salts such as tributylbenzyl ammounium-1-hydroxy-4-naphthosulfonate and tetrabutylammonium tetrafluoroborate, and analogues thereof provided as phosphonium salts and other onium salts, and lake pigments thereof; triphenylmethane dye and lake pigments thereof (a laking agent is phosphotungstic acid, phosphomolybdic acid, phosphotungstic molybdic acid, digallic acid, lauric acid, gallic acid, ferricyanide, ferrocyanide, or the like); metal salts of higher fatty acid; diorganotin oxides such as dibutyltin oxide, dioctyltin oxide, and dicyclohexyltin oxide; diorganotin borates such as dibutyltin borate, dioctyltin borate, and dicyclohexyltin borate; guanidine compounds; and imidazol compounds. Each of these compounds may be used in isolation or two or more of these compounds may be used in combination. Of those, triphenyl methane compounds and quaternary ammonium salts in which counter ions are not halogen are preferably used. In addition, a monopolymer of monomers represented by the following formula (II) and a copolymer with polymerizable monomers such as styrene, acrylic ester, and metacrylic ester can be used as agents for controlling positive-charging property.

(II)

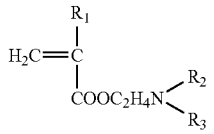

(wherein $R^1$ denotes H or $CH_3$, and $R_2$ and $R_3$ denote substituted or unsubstituted alkyl group (preferably having 1 to 4 carbon atoms).

In this case, each of the monopolymer and the copolymer functions as a charge control agent and functions as a binder resin (the whole or part thereof).

As a method for providing the toner with the charge control agent, there are a method for adding such an agent into the insides of toner particles and a method for external addition of such an agent to toner particles. The usage amount of the charge control agent is determined by the type of binder resin, the presence or absence of other additive, and the method for preparing toner, such as a dispersion method.

The charge control agent may be preferably used at a concentration of 0.1 to 10 parts by mass, more preferably 0.1 to 5 parts by mass with respect to 100 parts by mass of the binder resin but is not uniquely limited thereto.

A preferable method for preparing the toner of the present invention is one in which the materials that constitute the toner as described above are sufficiently mixed using a ball mill or other mixer, the resulting mixture is well kneaded using a thermal kneader, such as a thermal roll kneader or an extruder, and then subjected to cold-setting, mechanical pulverization, and classification of pulverized powder to obtain the desired toner. Furthermore, there are other methods, such as a polymerization method in which a monomer to be used for constructing the binder resin is mixed with a predetermined material to provide an emulsifying suspension solution, followed by polymerizing the mixture to obtain the toner; a method in which a predetermined material is included in a core material and/or a shell material, which constitute a microcapsule toner; and a method in which structural components are dispersed in the binder resin solution, followed by spray-drawing to obtain the toner. Furthermore, if required, the desired additive and the toner particles are sufficiently mixed with a mixer using one of the methods described above to prepare the toner of the present invention.

Here, the configuration of an image forming apparatus as an embodiment for conducting an image forming method of the present invention will be described with reference to FIG. 1. The image forming apparatus shown in FIG. 1 is a laser printer (a recording apparatus) of a development-cleaning process (cleanerless system) that utilizes a transfer-type electrophotographic process. The image forming apparatus has a process cartridge from which a cleaning unit having a cleaning member, such as a cleaning blade, is removed. In this apparatus, the toner used is magnetic toner (magnetic one-component system developer). In addition, the image forming apparatus is shown as an example of an image forming apparatus that performs non-contact development where a magnetic toner layer on the toner carrying member and an image bearing member are kept away from each other.

In the figure, reference numeral 1 denotes a rotating-drum type OPC photoconductor functioning as an image bearing member. The photoconductor is actuated so as to rotate in a clockwise direction (the direction indicated by the arrow inside photoconductor 1) at a circumferential speed (process speed) of 120 mm/sec.

Reference numeral 2 denotes a charging roller functioning as a contact-charging member. The charging roller 2 is arranged such that it is brought into press-contact with the photoconductor (the image bearing member) 1 under a predetermined press force against the elasticity thereof. In the figure, furthermore, reference symbol "n" denotes a charge-abutting portion as an abutting portion between the photoconductor 1 and the charging roller 2. In this embodiment, the charging roller 2 is actuated to rotate at a circumferential speed of 120 mm/second in the counter direction (the direction opposite to the direction in which the surface of the photoconductor moves) at the abutting portion n between the charging roller 2 and the photoconductor 1. The surface of the charging roller 2 functioning as a contact-charging member has a relative speed difference corresponding to a relative movement-speed ratio of 200% with respect to the surface of the photoconductor 1.

The relative movement-speed ratio that represents the relative speed difference can be expressed by the following equation.

$$\text{Relative movement-speed ratio}(\%)=|(Vc-Vp)/Vp|\times 100$$

(wherein, Vc is the movement speed of the surface of the charging member, and Vp is the movement speed of the surface of the image bearing member, in which Vc is a value having the same sign as that of Vp when the surface of the charging member moves in the same direction as that of the image bearing member).

In the present invention, the relative movement-speed ratio of the movement speed of the surface of the image bearing member and the surface of the charging member facing the surface of the image bearing member is preferably 10 to 500%, and more preferably 20 to 400%. When the relative movement-speed ratio is less than 10%, the contact probability between the contact-charging member and the image bearing member cannot be sufficiently increased. Therefore, it is difficult to maintain the charging property of the image bearing member with direct injection charging.

Furthermore, the amount of a toner component placed on the abutting portion between the image bearing member and the contact-charging member is restricted by sliding friction between the contact-charging member and the image bearing member, and therefore the charging inhibition of the image bearing member can be prevented. In the case that the relative movement-speed ratio is less than 10%, the above effect of preventing the charging inhibition becomes low, and further the effect of increasing the recovery of toner in the development-cleaning system by making the pattern of toner particles remaining after the transcription becomes low. When the relative movement-speed ratio is higher than 500%, the movement speed of the surface of the charging member is significantly increased. Therefore, the toner component brought into the abutting portion of the image bearing member and the contact-charging member easily allows the inside of the apparatus to be contaminated as the toner component flies in all directions. In addition, the image bearing member and the contact-charging member are likely to wear easily or to suffer scratches or the like on their surfaces, so that they tend to have a shorter useful life.

Furthermore, when the movement speed of the charging member is 0 (i.e., the charging member remains at rest), the contact point between the image bearing member and the charging member becomes a fixed point. Therefore, the wearing away or deterioration of the contacting portion of the charging member to the image bearing member is facilitated so that it is not preferable because the effect of preventing the charging inhibition on the image bearing member and the effect of increasing toner-recovering ability in the development-cleaning system by making the pattern of the transfer residual toner particles uniform are easily decreased.

On the surface of the charging roller 2, conductive metallic-compound fine particles are applied uniformly such that the particles make an even single layer.

In addition, a direct current of −700 volts is applied as a charging bias from an electrical power supply S1 for applying a charging bias to the metal core 2*a* of the charging roller 2. In this embodiment, the surface of the photoconductor 1 is uniformly subjected to a charging treatment with a potential (−680 volts) almost equal to a potential to be applied on the charging roller 2 by direct injection charging.

Reference numeral 3 denotes a laser beam scanner (an exposure device) including a laser diode, a polygon mirror, and so on. This laser beam scanner 3 generates a laser beam (L) whose intensity is modulated so as to correspond to chronological-order, electrical, digital pixel signals of the objective image information. The laser beam (L) is exposed to the uniformly charged surface of the photoconductor 1 by scanning with the laser beam. This scanning exposure operation forms an electrostatic latent image corresponding to the objective image information on the rotating photoconductor 1.

Reference numeral 4 denotes a developer. The electrostatic latent image on the surface of the photoconductor 1 is developed as a toner image using this developer 4. The developer 4 used in this embodiment is a non-contact reversal developer using a negative charge, magnetic, one-component insulative toner as the toner. The magnetic toner 4*d* contains magnetic toner particles (t) and metallic-compound fine particles (m).

Reference numeral 4*a* denotes a non-magnetic developing sleeve (toner carrying member) of 16 mm in diameter containing a magnet roll 4*b*, which is provided as a toner carrying member. The developing sleeve 4*a* is arranged such that it is placed at an opposed position 320 μm apart from the photoconductor 1. The developing sleeve 4*a* rotates at a peripheral speed ratio of 110% with respect to the peripheral speed of the photoconductor 1 such that the moving direction of the surface of the photoconductor 1 and the moving direction of the surface of the developing sleeve 4*a* are in the forward direction on the developing portion (the developing area) which is a portion opposite to the photoconductor 1.

Magnetic toner 4*d* is applied on the developing sleeve 4*a* using an elastic blade 4*c* to make a thin layer thereon. In other words, the layer thickness of the magnetic toner 4*d* to be formed on the developing sleeve 4*a* is regulated by the elastic blade 4*c* while electric charges are provided thereon.

A rotary motion of the developing sleeve 4*a* transfers the magnetic toner 4*d* coated on the developing sleeve 4*a* to the developing portion a of the developing sleeve 4*a*, which is opposed to the photoconductor 1.

In addition, a developing-bias applying electric power source S2 applies a developing-bias voltage on the developing sleeve 4*a*. In this case, the developing-bias voltage used is a combination of a DC voltage (−420 volts) and a rectangular AC voltage (1500 Hz in frequency and 1600 volts in peak-to-peak voltage (a field intensity of $5\times10^6$ V/m)). This developing bias permits a one-component jumping developing operation between the developing sleeve 4*a* and the photoconductor 1.

Reference numeral 5 denotes a middle-resistance transfer roller provided as a contact-transfer means, which forms a transfer nip portion b by press contact with the photoconductor 1 with a linear load of 98N per meter of contact length in the longitudinal direction. A sheet feeder (not shown) feeds a transfer material P, which is a recording medium, to the transfer nip portion b. At the same time, a transfer-bias applying power source S3 applies a predetermined transfer bias voltage on the transfer roller 5, allowing a toner image on the photoconductor 1 to be subsequently transferred to the surface of the transfer material P fed to the transfer nip portion b.

In this embodiment, the transfer roller 5 used is one having a resistivity of $5\times10^8$ Ωm, and the transfer of the toner image is performed by the application of a direct voltage of +2000 volts. The transfer material P introduced into the transfer nip portion b is nipped in the transfer nip portion b so as to be transferred. Then, the toner image being formed and retained on the surface of the photoconductor 1 is successively transferred to the surface side of the transfer material P by means of an electrostatic force and a press force.

Reference numeral 6 denotes a fixing device of a thermocompression fixation type. The transfer material P fed from the transfer nip portion b, on which the toner image has been transferred from the photoconductor 1, is separated from the surface of the photoconductor 1 and is then introduced into the fixing device 6. Subsequently, the fixing device 6 fixes the toner image and discharges it outside as an image-forming product (printed matter or copy).

It is noted that any cleaning unit is removed from the image forming apparatus of this embodiment in advance. Therefore, there is no step of removing the toner that has remained on the surface of the photoconductor 1 after the transfer of toner image to the transfer material P (i.e., the remaining toner after the transfer is never removed with a cleaner). The remaining toner is transferred to the developing portion a through the charge-abutting portion n by a rotary motion of the photoconductor 1, followed by being subjected to development-cleaning (recovery) in the developing device 4.

The image forming apparatus of this embodiment includes a process cartridge in which three processing devices, the photoconductor 1, the charging roller 2, and the developing device 4, are collectively included. The process cartridge is designed to be detachably attached onto the body of the image forming apparatus. It is noted that a combination of processing devices to be collectively included in the process cartridge is not limited to the above-mentioned combination and any combination thereof is arbitrarily allowed.

At the time of developing the electrostatic latent image on the photoconductor 1 by the developer 4, an appropriate amount of the metallic-compound fine particles m mixed in the magnetic toner 4*d* is transferred to the photoconductor 1 together with toner particles t.

The toner image (i.e., toner particles t) on the photoconductor 1 is pulled and actively transferred to the transfer material P under the influence of transfer bias in the transfer portion b. However, the metallic-compound fine particles m on the photoconductor 1 are not actively transferred to the transfer material P because of their conductive property. Thus, these particles are substantially attached and retained on the photoconductor 1 such that they remain in place.

In the present invention, as the step of cleaning is not included in the image forming apparatus, the remaining toner particles t and the metallic-compound fine particles m, which remain on the surface of the photoconductor 1 after the transfer, are conveyed to the charge-abutting portion n, which is an abutting portion between the photoconductor 1 and the charging roller 2 of the contact-charging member, with a rotary motion of the photoconductor 1 to allow them to be attached on or mixed in the charging roller 2. Therefore, under the conditions in which the metallic-compound fine particles m are present in the charge-abutting portion n, the direct injection charging is performed on the photoconductor 2.

The presence of the metallic-compound fine particles allows the photoconductor 1 to retain its fine contact and contact resistance against the charging roller 2 even though the toner particles t are attached on and mixed in the charging roller 2. Therefore, the charging roller 2 is allowed to perform the direct injection charging to the photoconductor 1.

The charging roller 2 is brought into fine contact with the photoconductor 1 through the metallic-compound fine particles m, and the metallic-compound fine particles m are brought into a state of sliding friction on the surface of the photoconductor 1 without any clearance between them. Consequently, a stable and safe direct injection charging without using a discharge phenomenon becomes dominant in the process of charging the photoconductor 1 using the charging roller 2. In other words, a high charging efficiency, which cannot be obtained by the conventional roller charging or the like, can be obtained, so that the photoconductor 1 can be provided with a potential almost equal to the potential applied on the charging roller 2. Furthermore, the toner particles t remaining after the transfer, which are attached on or mixed in the charging roller 2, are gradually discharged from the charging roller 2 to the photoconductor 1 and then reach the developing portion a as the surface of the photoconductor 1 moves, followed by being subjected to the development-cleaning operation (recovery) in the developing device 4.

The developing-cleaning operation is provided for recovering the toner particles remaining on the photoconductor 1 after transfer by the direct current applied to a fogging-removing bias of the developing device (a fogging-removing potential difference V back, which a potential difference between the direct voltage applied on the developing device and the surface potential of the photoconductor) at the time of subsequent development (at the time of developing a latent image after having undergone the charging and exposure steps again after the development) in the process of image formation. In the case of reverse development, such as of the image forming apparatus of this embodiment, the developing-cleaning operation is performed by the actions of the electric field for recovering the toner particles from the dark potential portions of the photoconductor to the developing sleeve with the developing bias and the electric field for adhering (developing) the toner particles to the light potential portions of the photoconductor from the developing sleeve.

In addition, as the image forming apparatus is actuated, the metallic-compound fine particles m contained in the toner in the developing device 4 are transferred to the surface of the photoconductor 1 at the developing portion a and are then conveyed to the charge-abutting portion n through the transfer portion b as the surface of the photoconductor 1 moves. Therefore, new metallic-compound fine particles m are successively fed to the charge-abutting portion n, so that the charging property of the charging member is prevented from being decreased even though the number of the metallic-compound fine particles m on the charge-abutting portion n is decreased by falling or the metallic-compound fine particles m on the charging portion n deteriorate. Consequently, the good charging property of the charging member can be kept stable.

In the image forming apparatus that includes a contact charging means, a transfer means, and a toner-recycling process mechanism, a uniform charging property can be provided under a low application voltage using a simple charging roller 2 as a contact charging member. Furthermore, in spite of contamination of the charging roller 2 with toner particles remaining after the transfer, the direct injection charging without ozone can be kept stable for a long time to provide the charging roller 2 with a uniform charging property. Therefore, it becomes possible to obtain an image forming apparatus without causing any difficulties due to the generation of ozone, due to poor charging, and so on, while having a simple configuration and being manufactured at a lower cost.

Furthermore, as described above, the metallic-compound fine particles m should have a resistivity of $1\times10^{9}$ Ωcm or less so as not to cause a deterioration in the charging property. However, in the case of using a contact-developing device by which a developer is directly brought into contact with the photoconductor 1 at the developing portion a, charges are injected into the photoconductor 1 by the developing bias through the metallic-compound fine particles m in the toner when the resistance of the metallic-compound fine particles m is too small, resulting in image fogging.

In this embodiment, however, the developing device is a non-contact developing device, so that there is no injection of developing bias into the photoconductor 1 and a fine image can be obtained. For preventing the generation of charge injection into the photoconductor 1 at the developing portion a, it is possible to provide a high potential difference between the developing sleeve 4*a* and the photoconductor 1, such as using an alternating bias. Consequently, the metallic-compound fine particles m become easy to be uniformly developed, so that the metallic-compound fine particles m can be uniformly applied on the surface of the photoconductor 1 to allow uniform contact at the charging portion.

Thus, a good charging property can be obtained, allowing the formation of a fine image.

It is possible to easily and effectively create a difference between the speed of the charging roller 2 and the speed of the photoconductor 1 by the lubrication effect (friction-reduction effect) of the metallic-compound fine particles m on the contact surface n between the charging roller 2 and the photoconductor 1. Such a lubrication effect decreases the friction between the charging roller 2 and the photoconductor drum 1 and also decreases the driving torque to prevent the surface of the charging roller 2 or the surface of the photoconductive drum 1 from cutting or scratching in advance. In addition, the generation of such a speed difference allows a significant increase in the chance that the metallic-compound fine particles m will be brought into contact with photoconductor 1 at a charge-abutting portion n between the charging roller 2 and the photoconductor 1 to attain a high contacting ability. Therefore, good direct injection charging can be obtained, allowing the formation of a fine image in a stable manner.

In the present embodiment, the charging roller 2 is designed to rotate in the direction opposite to the direction of moving of the surface of the photoconductor 1. Therefore, the toner particles remaining after the transfer on the photoconductor 1, which are to be carried to the charge-abutting portion n, are temporarily collected in the charging roller 2, thereby obtaining an effect of making uniform the amount of existing toner particles remaining after the transfer at the charging portion n. The generation of poor charging to be caused by uneven distribution of the toner particles at the charge-abutting portion n can be prevented, allowing the charging to be performed in a more stable manner.

Furthermore, it is possible to perform the direct injection charging predominantly by rotating the charging roller 2 in a reverse direction to temporarily separate the toner particles remaining after the transfer on the photoconductor 1 from the photoconductor 1. In addition, it is also possible to obtain an effect of reducing the falling down of the metallic-compound fine particles m from the charging roller 2. Therefore, there is no possibility of a decrease in the charging property of the image bearing member to be caused by the falling of an excessive amount of the metallic-compound fine particles m from the charging roller 2.

Furthermore, the toner remaining after the transfer, which is attached on or mixed into the contact-charging member, is an inhibiting factor for the charging. Thus, there is provided a mode (a mode for cleaning the contact-charging member) for efficiently removing the remaining toner from the contact-charging member at the time of non-image recording between sheets of paper (paper-to-paper period). Consequently, when the toner of the present invention is used in the image forming method that keeps a low contamination level of the contact-charging member due to the toner remaining after the transfer under normal conditions, further excellent charging and imaging properties can be kept stable for a long time.

In other words, the toner remaining after the transfer contaminating the contact-charging member is efficiently discharged and high charging characteristics after the formation of an image having a high image ratio can be attained by applying voltages of DC+AC on the contact-charging member while providing the apparatus with a mode of cleaning the contact-charging member and allowing the contact-charging member to retain the metallic-compound fine particles.

Conventionally, the contact-charging member and the toner are strongly attached with each other. In this embodiment, however, metallic-compound fine particles are provided as charging-prompting particles and placed between the contact-charging member and the toner, followed by the application of an AC bias of 5 to 1000 Hz to decrease the adhesion between the contact-charging member and the toner and to generate an appropriate potential difference between the contact-charging member and the image bearing member. Consequently, the contact-charging member can be quickly cleaned. The charging method with direct injection is able to charge the image bearing member with the potential almost equal to the applied voltage. Thus, in this method, the potential difference between the contact-charging member and the image bearing member is very small, so that a perfect cleaning of the member is difficult even using the metallic-compound fine particles. For solving this problem, this embodiment provides an appropriate condition for the discharge of toner at a frequency of 5 to 1000 Hz, which is easy to generate given the difference in biases before and after the charging operation.

If the frequency is less than 5 Hz, the potential unevenness is generated on the image bearing member depending on the frequency, while easily generating the unevenness in the image density. On the other hand, when the frequency exceeds 1000 Hz, it is impossible for the toner to move at this frequency, so that the cleaning effect decreases while the charging property tends to be decreased.

In the case of using the toner of the present invention in a cleanerless system having the step of direct injection charging, the photoconductor as the image bearing member to be used has at least a photosensitive layer and a charge injection layer on a conductive support. The photoconductor shows excellent performance with respect to the fogging of the image and the charging property when the relationship between a elastic deformation rate of We-OCL (%) measured on a charge injection layer and the elastic deformation rate of We-CTL (%) measured on the photosensitive layer satisfies the following expression (1) wherein d denotes the film thickness (μm) of the charge injection layer.

$$-0.71\times d+(We\text{-}CTL\ (\%))\leqq(We\text{-}OCL\ (\%))\leqq 0.03\times d^3-0.89\times d^2+8.43\times d+We\text{-}CTL\ (\%) \quad (1)$$

The elasticity deformation rates We-OCL and We-CTL are defined by the following expressions (2) and (3), respectively.

$$We\text{-}OCL\ (\%)=[We1/(We1+Wr1)]\times 100 \quad (2)$$

(wherein We1 denotes a work load (nJ) of the elastic deformation on the charge injection layer measured under the measuring environments of 23° C. in temperature and 55% RH in humidity, and Wr1 denotes a work load (nJ) of the plastic deformation on the charge injection layer measured under the measuring environments of 23° C. in temperature and 55% RH in humidity).

$$We\text{-}CTL\ (\%)=[We2/(We2+Wr2)]\times 100 \quad (3)$$

(wherein We2 denotes a work load (nJ) of the elastic deformation on the photosensitive layer measured under the measuring environments of 23° C. in temperature and 55% RH in humidity, and Wr2 denotes a work load (nJ) of the plastic deformation on the photosensitive layer measured under the measuring environments of 23° C. in temperature and 55% RH in humidity).

The excellent charging property of the photoconductor can be kept by controlling the elastic deformation rate We-OCL of the surface of the photoconductor within the above range. In this case, the embedding of metallic-compound fine particles can be prevented and also the fogging can be prevented by adjusting We-OCL to be equal to or less than the right side of the expression (1), while preventing the cutting on the surface of the photoconductor by adjusting We-OCL to be equal to or more than the left side of the expression (1).

It is preferable to use conductive particles for the formation of a charge injection layer. The useful conductive particles include metals, metal oxides, and carbon black. Each of them may be used in isolation or two or more of them may be used in combination. When two or more of them are used in combination, they may be simply mixed together or may be provided as a solid solution or a fused product.

The average particle diameter of the conductive particles used in the present invention is preferably 0.3 μm or less, and more preferably 0.1 μm or less in terms of the transparency of the charge injection layer.

More preferably, among the conductive particles, it is preferable to use metal oxide in terms of the transparency of the charge injection layer. As described above, when the conductive particles are constructed of the same metal element as that of the metallic-compound fine particles to be added in the toner in particular, an excellent charging property can be obtained.

For measuring the various kinds of physical properties of the metallic-compound fine particles contained in the toner, each measurement is performed as follows. That is, at first, a printer prints images or the like on a plurality of sheets of paper under the conditions except for a cleaning mode in the cleanerless system, followed by removing a toner container 4 and attaching a cleaner (not shown) in place of the toner container 4. Subsequently, the printer is actuated under the conditions with a full-time cleaning mode to collect the metallic-compound fine particles in a cleaner container. Then, the collection of such particles is repeated until a sufficient amount of the powder is collected in the container, followed by conducting each measurement.

EXAMPLES

Hereinafter, we will describe the present invention in detail with reference to production examples and practical examples. However, the present invention is not limited to these examples. Here, all of the part numbers in the compositions described below represents parts by mass.

Production Example 1 of Metallic-Compound Fine Particles

Thin chloride and antimony chloride were mixed and dissolved at a mole ratio of 100:7 in a hydrochloric acid aqueous solution of pH=about 1, followed by heating up to a temperature of 80° C. Then, a sodium hydroxide aqueous solution was added in the mixture to allow the generation of a coprecipitated product. Subsequently, the coprecipitated product was filtrated and washed to obtain a slurry of metallic-compound fine particles. The resulting slurry was dried and pulverized, followed by baking at 500° C. for 3 hours and then pulverizing the baked product again to obtain metallic-compound fine particles 1. The resulting metallic-compound fine particles 1 had a specific surface area of $16\times10^5$ $cm^2/cm^3$, a volume resistance of $6\times10^1$ Ωcm, $D_{50}$=1.9 μm, $D_{90}$=3.6 μm, $D_{10}$=0.7 μm, and a tin oxide content of 91% by mass.

Production Example 1 of Toner

| | |
|---|---|
| (a) A binder resin (styrene-acryl resin having a glass transition temperature Tg of 58° C. in DSC measurement, an acid value of 23.0 mgKOH/g, a number-average molecular weight (Mn) of 7000 in GPC, a weight-average molecular weight (Mw) of 400000, a monomer ratio: 72.5 parts of styrene, 20 parts of n-butylacrylate, 7 parts of mono-n-butylmalate, and 0.5 parts of divinylbenzene) | 100 parts |
| (b) Magnetic iron oxide (an average particle diameter of 0.20 μm, a BET specific surface area of 8.0 $m^2/g$, an anti-magnetic force of 3.7 kA/m, a saturation magnetization of 82.3 $Am^2/kg$, and a residual magnetization of 4.0 $Am^2/kg$) | 95 parts |
| (c) Polypropylene wax (a melting point of 143° C., and a penetration of 0.5 mm at 25° C.) | 4 parts |
| (d) Charge-controlling agent (Iron complex of azo compound, T77 manufactured by Hodogaya Chemicals, Co., Ltd.) | 2 parts |

The above materials (a)–(d) were molten and mixed by a two-spindle extruder heated at 130° C. Then, the mixture being cooled down was roughly pulverized with a hummer mill. For the pulverization, a turbo mill (manufactured by Turbo Kogyo, Co., Ltd.) was used and a mechanical pulverization was performed. Using a multiple separation and classification apparatus (Elbow-Jet classifier manufactured by Nittetsu Mining, Co., Ltd.) on the basis of the Coanda effect, the resulting fine pulverized products were exactly classified to remove ultra-fine particles and rough powder while obtaining magnetic toner particles 1. The weight-average diameter of the magnetic toner particles was 7.8 μm and the specific gravity thereof was 1.7 $g/cm^3$.

Next, magnetic particles 1 were obtained as follows.

| | |
|---|---|
| (A) Magnetic toner particles 1 | 100 parts |
| (B) Hydrophobic silica with a primary average particle diameter of 8 nm (Hydrophobic silica with a BET specific surface area of 100 $m^2/g$, which have been subjected to a hydrophobic treatment with dimethyl silicon oil and hexamethyldisilazane) | 1.0 part |
| (C) Metallic-compound fine particles 1 | 0.4 parts |

The above materials (A)–(C) were subjected to a mixing treatment for 180 seconds using a Henschel mixer FM10C/1 (manufactured by Mitsui Mining, Co., Ltd.). Subsequently, hydrophobic silica and metallic-compound fine particles are externally added to magnetic toner particles to obtain magnetic toner 1. The weight-average diameter of the resulting magnetic toner 1 was 7.8 μm and the floodability index thereof was 90.

Production Example 1 of Photoconductor

An aluminum cylinder of 30 mm in diameter and 260.5 mm in length was used as a support. A polyamide resin in methanol solution was applied on the support by dipping to make a base coating layer having a film thickness of 0.5 μm.

Using a sand mill device, 4 parts of oxytitanium phthalocyanine pigments, 2 parts of polyvinylbutyral resin, and 80 parts of cyclohexanon were dispersed for about 4 hours to obtain a dispersion solution. Then, the resulting dispersion solution was applied on the above base coating layer to form a charge generation layer of 0.2 μm in film thickness.

Next, 10 parts of a triphenylamine compound and 10 parts of a polycarbonate resin were dissolved in 100 parts of monochlorobenzene. The resulting solution was applied on the above charge generation layer, followed by drying with heated air to form a charge transport layer of 20 μm in film thickness.

Subsequently, a charge injection layer was prepared as follows. That is, 50 parts of antimony-doped tin oxide fine particles being surface-treated with silicon oil were dispersed in 150 parts of ethanol, followed by adding and dispersing 20 parts of polytetrafluoroethylene fine particles. Subsequently, 150 parts of a resol type thermo set phenol resin provided as a resin component were dissolved to obtain a blending solution.

Such a blending solution was applied on the charge transport layer described above by dip coating to form a film thereon, followed by drying with heated air to form a charge injection layer. Consequently, a photoconductor 1 was obtained. At this time, the film thickness of the charge injection layer of the photoconductor 1 was measured using an instantaneous multi-functional, multi-channel spectrophotometer MCPD-2000 (manufactured by Otsuka Electronics Co., Ltd.) on the basis of the interference of light for the thin film. As a result, the charge injection layer had a film thickness of 2 μm. An alternative method for film-thickness measurement may be a measurement with a direct observation of the cross section of the film of the photoconductor using SEM or the like.

The measurement of an elastic deformation rate We (%) was performed using the Fisher hardness meter (H100VP-HCU) described above. For measuring the elastic deformation We(%), loads were imposed on a film under measurement using a diamond indenter in the shape of a quadrangular pyramid having the tip portion with 136° in angle between the opposite faces such that the diamond indenter was pushed into the film at a depth of 1 μm. Then, the indentation depth under loads was electrically detected and read out. The elastic deformation rate We (%) was obtained using the above expression (expressions (2) and (3)) with the work load We (nJ) of the elastic deformation and the work load Wr (nJ) of the plastic deformation). The measurement was repeated 10 times while varying the measuring position for the sample and the average of the measured values obtained at eight points, except for the maximum and minimum values, was adopted as the elastic deformation rate We (%).

The measurement of the elastic deformation rate (We-OCL) of the charge injection layer was performed by direct measurement from the charge injection layer of the electrophotographic photoconductor, while the measurement of the elastic deformation rate (We-CTL) of the photosensitive layer was performed on the photosensitive layer after removing the charge injection layer. As a method for removing the charge injection layer, but not limited to, a lapping tape (C2000, manufactured by Fuji Photo Film Co., Ltd.) was used in a drum polishing device manufactured by Canon Inc. The elastic deformation rate of the photosensitive layer is measured at the time of completely removing the charge injection layer by grinding. During the grinding, the film thickness of the photosensitive layer should be measured frequently or the surface of the photosensitive layer is repeatedly observed not to grind the photosensitive layer after grinding the charge injection layer too much. After the charge injection layer is removed completely by the grinding, the measurement of the elastic deformation rate of the photosensitive layer is determined. However, it is confirmed that there is provided almost the same value as that of one without such a layer when the remaining film thickness of the photosensitive layer is 10 μm or more. Therefore, even though the photosensitive layer is ground too much, almost the same value can be obtained when the remaining film thickness of the photosensitive layer is 10 μm or more. However, more preferably, the measurement should be performed under the conditions in which the charge injection layer is removed as much as possible while the photosensitive layer is almost intact as much as possible.

The elastic deformation rate We-CRT(%) of the photoconductor 1 was 42, and the lower limit (on the left side) of expression (1) was 40.6, while the upper limit (on the right side) of expression (1) was 55.5. Likewise, the We-OCL(%) was 55.5.

Production Example 1 of Charging Member

An SUS roller of 6 mm in diameter and 264 mm in length was provided as a core bar. A middle resistance urethane foam layer composed of an urethane resin, carbon black as a conductive material, a sulfidizing agent, a foaming agent, and so on was formed in the shape of a roller on the core bar and was then subjected to cutting and grinding to trim the shape and the surface property of the layer, resulting in a flexible member to be provided as a charging member 2 of 12 mm in diameter and 234 mm in length.

The resulting charging member 2 has a resitivity of $10^5$ Ωcm and a hardness (Asker C) of 30 degrees.

Example 1

FIG. 1 shows a diagram that illustrates a schematic overall configuration of the image forming apparatus of the present example. More concretely, FIG. 1 shows a laser printer (a recording apparatus) of a developing-cleaning process (a cleanerless system) utilizing a transfer-type electrophotographic process. The laser printer has a process cartridge from which a cleaning means, having a cleaning member such as a cleaning blade, is removed. In this case, the toner used is magnetic toner 1. Furthermore, there is used a non-contact developing method in which an image bearing member and a magnetic toner layer on a toner carrying member are placed out of contact with each other.

The above photoconductor 1 as an image bearing member is a rotating-drum OPC photoconductor, which is imparted a rotary motion at a circumferential speed (a process speed) of 94 mm/sec in the direction of the arrow X in the figure.

As a contact-charging member, the charging member 1 obtained in the Production Example 1 of charging member is used as a charging roller 2, and as shown in the figure, the charging roller 2 is arranged such that the charging roller 2 is brought into press-contact with the photoconductor 1 under a predetermined press force against the elasticity thereof. In the figure, furthermore, reference symbol "n" denotes a charge-abutting portion as an abutting portion between the photoconductor 1 and the charging roller 2. In this example, the charging roller 2 is actuated to rotate at a 100% circumferential speed in the counter direction (the direction of the arrow Y) at the charge-abutting portion n. The surface of the charging roller 2 has a relative speed difference corresponding to a relative movement-speed ratio of 200% with respect to the surface of the photoconductor 1. Furthermore, on the surface of the charging roller 2, the above metallic-compound fine particles 1 are applied uniformly so as to have a coating amount of almost $1\times10^4/mm^2$.

In addition, the core bar 2*a* of the charging roller 2 is designed such that a DC voltage of −650 volts is applied as a charging bias from a charging-bias applying power source S1. In this example, the surface of photoconductor 1 is uniformly subjected to a charging treatment with a potential (−630 volts) almost equal to a voltage to be applied on the charging roller 2.

A laser beam scanner 3 (an exposure device), functioning as an exposure means, comprises a laser diode, a polygon mirror, and so on. This laser beam scanner 3 generates a laser beam (L) in which the intensity thereof is modulated so as to correspond to chronological-order, electrical, digital pixel signals of the objective image information to expose the uniformly charged surface of the photoconductor 1 by scanning with the laser beam. This scanning exposure device forms an electrostatic latent image corresponding to the objective image information on the photoconductor 1. The electrostatic latent image on the surface of the photoconductor 1 is developed as a toner image using this developer 4 as a developing means.

The developer 4 used in this example is a non-contact reversal developer using the magnetic toner 1 as toner.

A toner carrying member is a developing sleeve 4*b* prepared by forming a resin layer having a layer thickness of about 7 μm and a JIS arithmetical mean deviation (Ra) of 1.0 μm on an aluminum cylinder of 16 mm in diameter having the surface being blasted. In addition, a magnetic roll having a developing magnetic pole of 90 mT (900 Gauses) is installed in the toner carrying member. As a toner layer regulating member which restricts the thickness of a toner layer, there is provided an elastic blade 4*c* made of urethane (1.0 mm in thickness and 1.5 mm in free length). The elastic blade 4*c* was brought into contact with the toner carrying member 4 with a linear load of 29.4 N/m (30 g/cm). The clearance between the photoconductor 1 and the developing sleeve 4*a* was 290 μm.

The composition of the resin layer used for forming the developing sleeve 4*b* is as follows.

| | |
|---|---|
| Phenol resin | 100 parts |
| Graphite (a volume average particle diameter of about 7 μm) | 90 parts |
| Carbon black | 10 parts |

The developing sleeve 4*a* rotates at a peripheral speed ratio of 120% to the peripheral speed of the photoconductor 1 such that the moving direction of the photoconductor 1 and the moving direction (direction of arrow W) of the developing sleeve 4*a* are in the forward direction on the developing portion (the developing area) a, which is a portion opposite to the photoconductor 1.

Toner is applied on the developing sleeve 4*a* using an elastic blade 4*c* to make a thin layer thereon. In other words, the layer thickness of the toner is regulated by the elastic blade 4*c* with respect to the developing sleeve 4*a* while electric charges are provided thereon. At this time, the amount of magnetic toner coated on the developing sleeve 4*a* was 16 g/m$^2$.

A rotary motion of the developing sleeve 4*a* transfers the magnetic toner 4*d* coated on the developing sleeve 4*a* to the developing portion a of the developing sleeve 4*a*, which is opposed to the photoconductor 1. A developing-bias applying electric power source S2 applies a developing-bias voltage on the developing sleeve 4*a*. In this case, the developing-bias voltage used is a combination of a DC voltage (−440 volts) and a rectangular AC voltage (1600 Hz in frequency and 1500 volts in peak-to-peak voltage (a field intensity of 5×10$^6$ V/m)). This developing bias permits a one-component jumping developing operation on the developing portion a between the developing sleeve 4*a* and the photoconductor 1.

A middle resistance transfer roller 5 functioning as a contact transfer means forms a transfer abutting portion b by press contact with the photoconductor 1 with a linear load of 98 N/m (100 g/cm). A sheet feeder (not shown) feeds a transfer material P to the transfer abutting portion b at a predetermined timing. Then, a transfer-bias applying power source S3 applies a predetermined transfer bias voltage on the transfer roller 5, allowing the toner image on the photoconductor 1 to be subsequently transferred to the surface of the transfer material P fed to the transfer abutting portion b.

In this example, the transfer roller 5 used is one having a resistivity of 5×10$^8$ Ωm, and the transfer of the toner image is performed by the application of a direct voltage of +2000 volts. The transfer material P introduced in the transfer abutting portion b is nipped in the transfer abutting portion b so as to be transferred. Then, the toner image being formed and retained on the surface of the photoconductor 1 is successively transferred to the surface of the transfer material P by means of an electrostatic force and a press force. The transfer material P fed to the transfer abutting portion b, on which the toner image has been transferred from the photoconductor 1, is separated from the surface of the photoconductor 1 and is then introduced into a fixing device 6 serving as a fixing means such as the thermal fixing-type fixing device. Subsequently, the fixing device 6 fixes the toner image on the transfer material P and discharges it as an image-forming product (printed matter or copy) outside the device.

It is noted that any cleaning unit is removed in advance from the image forming apparatus of this example. Therefore, the toner remaining on the surface of the photoconductor 1 after the transfer of the toner image to the transfer material P is never removed with a cleaner. The remaining toner is transferred to the developing portion a through the charging-abutting portion n by a rotary motion of the photoconductor 1, followed by being subjected to the development-cleaning (recovery) in the developing device 4.

The toner is an insulative material, so that the mixing of the remaining toner to the charge-abutting portion n is a factor for causing poor charging in the step of charging the photoconductor. In this case, however, the metallic-compound fine particles 1 having a large value of BET are located on the charging portion n between the charging roller 2 and the photoconductor 1. Therefore, the exact contacting ability of the charging roller 2 to the photoconductor 1 and the contact resistance thereof can be kept constant, so that the direct charging without ozone at a low applied voltage can be retained stable for a long time even though the remaining toner after the transfer contaminates the charging roller 2. Consequently, the uniform charging property of the photoconductor 1 can be obtained.

In the above example, 100 g of magnetic toner 1 was filled in a toner cartridge of the above image forming apparatus and was then used until the amount of the toner in a toner cartridge becomes less than a predetermined level by forming an image pattern comprised of lateral lines with a printing surface ratio of 2%. As a transfer material, copying paper (A4) of 75 g/m2 was used as a transfer material, and then printing is performed on 1000 sheets of printing paper intermittently one by one.

[Evaluation]

The transfer efficiency was estimated as follows. That is, a mylar tape was placed on toner remaining on the photoconductor after the transfer of a solid black image and was then peeled off. Then, the Macbeth density of the tape placed on paper is defined as C. Also, the Macbeth density of mylar tape placed on the paper on which the magnetic toner after transfer but before fixation is mounted is defined as D, and the Macbeth density of mylar tape placed on unused paper is defined as E. Then, the transfer efficiency was approximately calculated using the following expression. If the transfer efficiency is 80% or more, the resulting image has no problem in practical use.

$$\text{Transfer efficiency}(\%)=[(D-C)/(D-E)]\times 100$$

The resolving power at the time of completing the durability was evaluated as follows by the reproducibility of an isolated one dot having a small diameter at 600 dpi, which was hard to be reproduced, while the electric field is easily closed by the electric field of an electrostatic latent image.

A: Very good. 5 or less deficits in 100.

B: Good. 6 to 10 deficits in 100.

C: Practically usable. 11 to 20 deficits in 100.

D: Practically unusable. 21 or more deficits in 100.

The fogging on paper was measured using a reflectometer Model TC-6DS manufactured by Tokyo Denshoku Co., Ltd. The filter used was a green filter. The numeric value of the fogging was calculated using the following expression with respect to a solid white image. An image was regarded as a good one when the fogging on paper was 2.0% or less.

$$\text{Fogging (Reflectivity)}(\%) = (\text{Reflectivity}(\%) \text{ on the standard paper}) - (\text{Reflectivity}(\%) \text{ of the sample non-image portion})$$

The image concentration was measured using a Macbeth densitometer RD918 (manufactured by Macbeth Co., Ltd.). The initial density was on the 20th sheet from the initiation of image formation.

The charging property was evaluated using an image pattern having an upper portion (a width of 3 cm from the upper edge of an image) which is provided as a mixed image of a solid image and a non-image and another portion except for the upper portion (3 cm or more from the upper edge of the image) which has a uniform half tone image. In other words, the above image pattern is a ghost image from which a charging ghost image easily occurs, and the charging property was evaluated using the ghost image. The image density of the half tone portion corresponding to the non-image portion was measured. In addition, the image density of the half tone portion to be developed was measured and was more dense because of a defect in charging property, which corresponds to the solid image portion. Then, the difference between these image densities was obtained. As a result, the smaller the difference, the better the charging property, between them. In addition, when the difference between these densities exceeds 0.20, a ghost image becomes significant and is a practical problem.

The durability test under normal temperature and humidity did not find any decrease in development characteristics and a fine image was obtained. After that, the same experiment was conducted under a low-temperature and low-humidity environment (15° C./10%) and under high-temperature and a high-humidity environment (30° C./90%). However, in each of the environments, a decrease in development characteristics could not be observed.

Next, on the surface of the charging roller 2, a mixture of the metallic-compound fine particles 1 and the magnetic toner (1:1) was applied in an amount of about 0.5 g. Then, the charging property of the photoconductor was estimated under a low-temperature and low-humidity environment. The ghost images were successively printed on five sheets of paper, and then the evaluation was conducted on the image printed on the fifth sheet of paper. As a result, the difference of density in the ghost portions was 0.04, which was an excellent result. Consequently, an excellent charging property of the photoconductor was obtained.

The results are listed in Table 3.

Production Examples 2 to 16 of Metallic-Compound Fine Particles

Metallic-compound fine particles 2 to 16 were prepared in the same way as that of Production Example 1 of metallic-compound fine particles, by appropriately adjusting the concentration of tin chloride, the mole ratio of tin and antimony, the addition speed of a sodium hydroxide aqueous solution, baking temperatures, and baking hours. The physical property of the obtained fine particles was shown in Table 1.

Production Example 17 of Metallic-Compound Fine Particles

An alkaline sodium stannate aqueous solution was kept at 60° C. to 80° C. Then, a sulfuric acid aqueous solution was added in the mixture such that the pH thereof was not less than 7 to generate precipitate, followed by filtering and washing to obtain a slurry of metallic-compound fine particles. Then, the obtained slurry was dried and pulverized, followed by baking under a nitrogen atmosphere for 400° C. at 2 hours and baking under nitrogen/hydrogen mixture gas atmosphere at about 500° C. for 1 hour. Then, the resulting product was pulverized again to obtain metallic-compound fine particles 17. The physical property of the resulting metallic-compound fine particles 17 was a specific surface area of $33\times10^5$ $cm^2/cm^3$, a volume resistivity of $9\times10^2$ Ωcm, $D_{50}$=1.1 μm, $D_{90}$=2.4 μm, and $D_{10}$=0.6 μm. The content of tin oxide was 99% by mass.

Production Example 18 of Metallic-Compound Fine Particles

An ammonium carbonate aqueous solution and an aluminum sulfate aqueous solution were mixed together and were then placed in an aqueous solution in which zinc oxide was being dispersed, followed by stirring at 60° C. for 1 hour. Subsequently, the mixture was filtrated and washed with water to obtain a slurry. The slurry was dispersed in deionized water and was then kept at 30° C. while blowing carbon dioxide for four hours. The product was left alone for a while and then the supernatant was discarded. The remaining slurry was dried with a spray drier, resulting in a dried powder. The resulting powder was subjected to thermolysis at 250° C. for 5 hours, thereby obtaining metallic-compound fine particles 18 formed of conductive zinc oxide fine particles.

Production Example 19 of Metallic-Compound Fine Particles

In a heating mixer, a solution containing 100 parts of ethanol and 2 parts of iso-butyl trimethoxysilane were added with respect to 100 parts by mass of the metallic-compound fine particles 1 and the solution was stirred while spraying at 80° C. for mixing, and after completing the spraying the temperature was elevated to 120° C. for heat treatment for 30 minutes. After being taken out, the product was cooled to room temperature and pulverized to obtain metallic-compound fine particles 19 on which a surface treatment was conducted.

Production Example 20 of Metallic-Compound Fine Particles

In a heating mixer, a solution containing 100 parts of ethanol and 2 parts of amino-modified silicone oil were added with respect to 100 parts by mass of the metallic-compound fine particles 1 and the solution was stirred while spraying at 80° C. for mixing, and after completing the spraying, the temperature was elevated to 150° C. for heat treatment for 30 minutes. After being taken out, the product was cooled to room temperature and pulverized to obtain metallic-compound fine particles 20 on which a surface treatment was conducted.

Production Examples 2 to 20 of Toner

Using the magnetic toner particles 1, magnetic toner 2 to 20 was prepared in the same way as that of Production Example 1 of toner, except for the use of the metallic-compound fine particles 2 to 20 instead of the metallic-compound fine particles 1. The physical properties of the resulting magnetic toners 2 to 20 were shown in Table 2.

Production Examples 21, 22 of Toner

Magnetic toner 21 was prepared in the same way as that of Production Example 1 of toner, except for using titanium oxide having a primary particle diameter of 50 nm and a BET of 100, which is subjected to a surface treatment with iso-butyl trimethoxysilane, instead of hydrophobic silica. Magnetic toner 22 was also prepared in the same way as that of Production Example 1 of toner, except for using aluminum oxide having a primary particle diameter of 7 nm and a BET of 110, which is subjected to a surface treatment with iso-butyl trimethoxysilane, instead of hydrophobic silica. The physical properties of the resulting magnetic toners 21 and 22 were shown in Table 2.

Production Example 23 of Toner

Magnetic toner 23 was prepared in the same way as that of Production Example 1 of toner, except for using hydrophobic silica having a primary particle diameter of 90 nm instead of hydrophobic silica having a primary particle diameter 8 nm. The physical property of the resulting magnetic toner 23 was shown in Table 2.

Production Example 24 of Toner

Magnetic toner 24 was prepared in the same way as that of Production Example 1 of toner, except that a time period for the mixing treatment using the Henschel mixer FM10C/1 (Mitsui Mining Co., Ltd.) was 300 seconds. The physical property of the resulting magnetic toner 24 was shown in Table 2.

Production Example 25 of Toner

Magnetic toner 25 was prepared in the same way as that of Production Example 1 of toner, except that the addition amount of the metallic-compound fine particles 1 was changed to 3.5 parts. The physical property of the resulting magnetic toner 25 was shown in Table 2.

Production Example 26 of Toner

Magnetic toner 26 was prepared in the same way as that of Production Example 1 of toner, except that the addition amount of the metallic-compound fine particles 1 was changed to 4.0 parts. The physical property of the resulting magnetic toner 26 was shown in Table 2.

Examples 2 to 23

Using the magnetic toners 3 to 12, and 15 to 26, an evaluation was performed under the same conditions as those of Example 1. The results were shown in Table 3.

Comparative Examples 1 to 3

Using the magnetic toners 2, 13, and 14, the evaluation was performed under the same conditions as those of Example 1. The results were shown in Table 3.

As is evident from the results of Examples 1, 2 and 9 to 11, and Comparative Example 1, it is found that an excellent charging property can be retained when the specific surface area of the metallic-compound fine particles to be used is $5\times10^5$ $cm^2/cm^3$ or more even though the charging member is contaminated with the adhesion of toner. It is found that a preferable amount is $10\times10^5$ $cm^2/cm^3$ or more, and a more preferable amount is $12\times10^5$ or more. On the other hand, as is evident from the results of Examples 1, 3, 4, 8, 11, and Comparative Example 2, the charging property tends to be decreased because the adhesive strength to the magnetic toner increases as the specific surface area of the metallic-compound fine particles becomes larger. It shows that when the specific surface area of metallic-compound fine particles is too large, there is a decrease in the amount of the metallic-compound fine particles remaining after the transfer to be conveyed to the abutting portion n of the charging roller. The specific surface area of metallic-compound fine particles is preferably of $80\times10^5$ $cm^2/cm^3$ or less, and more preferably of $40\times10^5$ or less. As is evident from the results of Example 13, it is found that fogging may become slightly worse when the metallic-compound fine particles contained in magnetic toner satisfy the following relationship:

$$100\times10^5/D_{50}<\text{Surface area per unit volume.}$$

As is evident from the results of Examples 1, 3, 5–8, and 11, and Comparative Examples 2 and 3, there is a tendency to lower the image density when $D_{50}$ and $D_{10}$ are small. An appropriate $D_{50}$ is 0.4 μm or more, preferably 0.5 μm more. In addition, $D_{10}$ is preferably 0.3 μm or more, and is more preferably 0.4 μm or more. On the other hand, when $D_{50}$ and $D_{90}$ are larger than the above ranges, the fogging becomes worse so that there is a tendency to decrease the resolving power. An appropriate $D_{50}$ is 4.0 μm or less, and preferably 3.5 μm or less. $D_{90}$ should be 6.0 μm or less, and preferably 4.0 μm or less.

As is evident from the results of Examples 1, 12, and 13, when the resistance of the metallic-compound fine particles is lowered, the image characteristics under high humidity tend to be decreased. However, there is no substantial problem when the resistivity of the metallic-compound fine particles is $1\times10^{-1}$ Ωcm or more. Furthermore, when the above resistivity increases, the charging property tends to be decreased. $1\times10^9$ or less may be sufficient.

As is evident from the results of Examples 1, 14, and 15, it is found that the charging 10' property and fogging become worse to a certain degree when there is no tin oxide in the metallic-compound fine particles.

As is evident from the results of Examples 1, 16, and 17, it is found that the metallic-compound fine particles may be subjected to the surface treatment with a silicon compound, particularly an amino-modified silicon oil treatment to obtain more preferable results with respect to the charging property and image characteristics.

As is evident from the results of Examples 1, and 18 to 23, when the floodability index of the magnetic toner becomes lowered, there is a tendency to cause a decrease in the charging property. However, if such an index is not less than 74%, and more preferably not less than 80%, it is found that a favorable charging property can be obtained. Furthermore, for obtaining favorable toner, (i) it is not preferable to use inorganic fine powder having an average primary particle diameter of 90 nm or more, while (ii) it is preferable to satisfy the condition of $X\times Y\leqq 6$.

TABLE 1

| Metallic-compound fine particles No. | Specific surface area ($cm^2/cm^3$) | $D_{50}$ (μm) | Volume resistivity (Ωcm) | $D_{10}$ (μm) | $D_{90}$ (μm) | Tin oxide content (wt %) |
|---|---|---|---|---|---|---|
| 1 | $16\times10^5$ | 1.9 | $6\times10$ | 0.7 | 3.6 | 93 |
| 2 (Comparative example) | $4\times10^5$ | 3.1 | $5\times10$ | 1.6 | 4.2 | 93 |
| 3 | $5\times10^5$ | 2.7 | $4\times10^5$ | 1.3 | 3.7 | 94 |
| 4 | $80\times10^5$ | 0.4 | $1.1\times10^2$ | 0.2 | 1.2 | 94 |
| 5 | $42\times10^5$ | 0.9 | $9\times10$ | 0.5 | 2.0 | 93 |
| 6 | $14\times10^5$ | 4.0 | 3 | 1.8 | 6.0 | 93 |
| 7 | $21\times10^5$ | 3.5 | $5\times10$ | 1.7 | 5.8 | 94 |
| 8 | $32\times10^5$ | 2.6 | $8\times10$ | 1.8 | 4.0 | 93 |
| 9 | $40\times10^5$ | 0.5 | $1.4\times10^2$ | 0.3 | 1.5 | 93 |
| 10 | $10\times10^5$ | 3.1 | 2 | 2.2 | 3.9 | 94 |
| 11 | $12\times10^5$ | 2.9 | 3 | 1.9 | 3.8 | 94 |
| 12 | $21\times10^5$ | 1.7 | $7\times10$ | 0.4 | 3.1 | 94 |
| 13 (Comparative example) | $84\times10^5$ | 0.3 | $4.3\times10^3$ | 0.1 | 1.1 | 93 |
| 14 (Comparative example) | $13\times10^5$ | 4.5 | 4 | 2.0 | 6.4 | 94 |
| 15 | $19\times10^5$ | 1.8 | $9\times10^8$ | 0.9 | 3.5 | 100 |
| 16 | $37\times10^5$ | 3.3 | $1\times10^{-1}$ | 1.6 | 4.0 | 87 |
| 17 | $33\times10^5$ | 1.1 | $9\times10^2$ | 0.6 | 2.4 | 99 |
| 18 | $28\times10^5$ | 2.1 | $1.5\times10^2$ | 1.1 | 3.8 | 0 |
| 19 | $13\times10^5$ | 2.0 | $9\times10$ | 0.8 | 3.7 | 91 |
| 20 | $14\times10^5$ | 2.0 | $9\times10$ | 0.8 | 3.8 | 91 |

TABLE 2

| Magnetic toner No. | Metallic-compound fine particles No. | Inorganic fine powder | Weight-average particle diameter of toner | X × Y | Flood-ability index of toner |
|---|---|---|---|---|---|
| 1 | 1 | Silica 1(*1) | 7.8 μm | 0.68 | 86 |
| 2 | 2 | Silica 1 | 7.8 μm | 0.68 | 86 |
| 3 | 3 | Silica 1 | 7.8 μm | 0.68 | 86 |
| 4 | 4 | Silica 1 | 7.8 μm | 0.68 | 86 |
| 5 | 5 | Silica 1 | 7.8 μm | 0.68 | 86 |
| 6 | 6 | Silica 1 | 7.8 μm | 0.68 | 86 |
| 7 | 7 | Silica 1 | 7.8 μm | 0.68 | 86 |
| 8 | 8 | Silica 1 | 7.8 μm | 0.68 | 86 |
| 9 | 9 | Silica 1 | 7.8 μm | 0.68 | 86 |
| 10 | 10 | Silica 1 | 7.8 μm | 0.68 | 86 |
| 11 | 11 | Silica 1 | 7.8 μm | 0.68 | 86 |
| 12 | 12 | Silica 1 | 7.8 μm | 0.68 | 86 |
| 13 | 13 | Silica 1 | 7.8 μm | 0.68 | 86 |
| 14 | 14 | Silica 1 | 7.8 μm | 0.68 | 86 |
| 15 | 15 | Silica 1 | 7.8 μm | 0.68 | 86 |
| 16 | 16 | Silica 1 | 7.8 μm | 0.68 | 86 |
| 17 | 17 | Silica 1 | 7.8 μm | 0.68 | 86 |
| 18 | 18 | Silica 1 | 7.8 μm | 0.68 | 86 |
| 19 | 19 | Silica 1 | 7.8 μm | 0.68 | 86 |
| 20 | 20 | Silica 2 | 7.8 μm | 0.68 | 86 |
| 21 | 1 | Titanium oxide(*2) | 7.8 μm | 0.68 | 83 |
| 22 | 1 | Alumima(*3) | 7.8 μm | 0.68 | 90 |
| 23 | 1 | Silica 2(*4) | 7.8 μm | 0.68 | 74 |
| 24 | 1 | Silica 1 | 7.8 μm | 0.68 | 74 |
| 25 | 1 (3.5 parts) | Silica 1 | 7.8 μm | 6.0 | 81 |
| 26 | 1 (4.0 parts) | Silica 1 | 7.8 μm | 6.8 | 77 |

(*1)Silica (average particle diameter 8 mn)

(*2)Titanium oxide (average particle diameter 50 nm)

(*3)Alumina (average particle diameter 7 nm)

(*4)Silica (average particle diameter 90 nm)

TABLE 3

| | | Normal temperature/normal humidity | | | | High temperature/high humidity | | | Low temperature/low humidity | | | |
|---|---|---|---|---|---|---|---|---|---|---|---|---|
| Example No. | Magnetic toner No. | Transfer property (%) | Fog (%) | Image density | Resolution | Transfer property (%) | Fog (%) | Image density | Transfer property (%) | Fog (%) | Image density | Density difference a ghost portion |
| Example 1 | 1 | 85 | 1.0 | 1.42 | B | 82 | 1.1 | 1.40 | 86 | 1.3 | 1.43 | 0.04 |
| Example 2 | 3 | 84 | 1.2 | 1.41 | B | 81 | 1.6 | 1.41 | 84 | 1.8 | 1.43 | 0.19 |
| Example 3 | 4 | 81 | 0.9 | 1.37 | B | 78 | 1.0 | 1.36 | 80 | 0.9 | 1.35 | 0.18 |
| Example 4 | 5 | 82 | 0.8 | 1.40 | B | 79 | 0.9 | 1.38 | 80 | 0.8 | 1.41 | 0.16 |
| Example 5 | 6 | 83 | 1.8 | 1.43 | C | 80 | 2.1 | 1.42 | 81 | 1.7 | 1.44 | 0.09 |
| Example 6 | 7 | 84 | 1.6 | 1.42 | C | 83 | 2.0 | 1.41 | 85 | 1.5 | 1.43 | 0.08 |
| Example 7 | 8 | 85 | 1.2 | 1.44 | B | 84 | 1.2 | 1.44 | 86 | 1.1 | 1.41 | 0.06 |
| Example 8 | 9 | 84 | 0.9 | 1.40 | B | 86 | 1.0 | 1.38 | 83 | 1.0 | 1.39 | 0.10 |
| Example 9 | 10 | 86 | 1.3 | 1.41 | B | 85 | 1.6 | 1.38 | 84 | 1.5 | 1.40 | 0.11 |
| Example 10 | 11 | 83 | 1.1 | 1.42 | B | 82 | 1.2 | 1.41 | 84 | 1.1 | 1.40 | 0.09 |
| Example 11 | 12 | 83 | 1.0 | 1.40 | B | 86 | 1.1 | 1.40 | 85 | 1.4 | 1.40 | 0.04 |

TABLE 3-continued

| Example No. | Magnetic toner No. | Normal temperature/normal humidity: Transfer property (%) | Fog (%) | Image density | Resolution | High temperature/high humidity: Transfer property (%) | Fog (%) | Image density | Low temperature/low humidity: Transfer property (%) | Fog (%) | Image density | Density difference a ghost portion |
|---|---|---|---|---|---|---|---|---|---|---|---|---|
| Example 12 | 15 | 87 | 1.0 | 1.43 | B | 89 | 0.8 | 1.42 | 84 | 1.4 | 1.39 | 0.09 |
| Example 13 | 16 | 76 | 1.8 | 1.34 | B | 74 | 1.9 | 1.29 | 80 | 1.6 | 1.41 | 0.05 |
| Example 14 | 17 | 89 | 0.7 | 1.43 | A | 88 | 0.8 | 1.43 | 89 | 0.7 | 1.44 | 0.03 |
| Example 15 | 18 | 82 | 1.8 | 1.36 | B | 84 | 1.9 | 1.34 | 83 | 1.9 | 1.38 | 0.13 |
| Example 16 | 19 | 89 | 0.6 | 1.44 | A | 89 | 0.7 | 1.43 | 88 | 0.5 | 1.46 | 0.03 |
| Example 17 | 20 | 91 | 0.5 | 1.46 | A | 90 | 0.6 | 1.45 | 90 | 0.5 | 1.47 | 0.02 |
| Example 18 | 21 | 78 | 2.1 | 1.34 | C | 76 | 2.0 | 1.33 | 80 | 2.0 | 1.35 | 0.09 |
| Example 19 | 22 | 81 | 2.0 | 1.32 | C | 80 | 1.9 | 1.33 | 82 | 2.1 | 1.31 | 0.09 |
| Example 20 | 23 | 71 | 2.2 | 1.36 | C | 70 | 2.2 | 1.34 | 72 | 2.1 | 1.37 | 0.20 |
| Example 21 | 24 | 70 | 2.2 | 1.36 | C | 70 | 2.2 | 1.34 | 73 | 2.1 | 1.37 | 0.19 |
| Example 22 | 25 | 86 | 0.9 | 1.43 | B | 83 | 1.0 | 1.41 | 87 | 1.2 | 1.44 | 0.18 |
| Example 23 | 26 | 87 | 0.8 | 1.44 | B | 84 | 0.9 | 1.42 | 88 | 1.1 | 1.45 | 0.20 |
| Comparative example 1 | 2 | 83 | 1.1 | 1.40 | B | 82 | 1.0 | 1.41 | 82 | 2.2 | 1.45 | 0.34 |
| Comparative example 2 | 13 | 81 | 0.7 | 1.31 | B | 79 | 0.7 | 1.29 | 80 | 0.7 | 1.34 | 0.32 |
| Comparative example 3 | 14 | 84 | 2.3 | 1.46 | D | 81 | 2.5 | 1.44 | 82 | 2.1 | 1.45 | 0.30 |

Production Examples 27 to 30 of Toner

Magnetic toner particles were manufactured in the same way as that of Production Example 1 of toner, except that the weight-average particle diameters of magnetic toner particles were adjusted to 2.8 μm, 3.0 μm, 12.0 μm, and 12.5 μm, respectively. Then, hydrophobic silica having a primary particle diameter of 8 nm was externally added to the resulting magnetic toner particles. For the magnetic toner particles of weight-average particle diameters of 2.8 μm and 3.0 μm, 2.5 parts of hydrophobic silica were externally added. For the magnetic toner particles of weight average particle diameters of 12.0 μm and 12.5 μm, the hydrophobic silica of 0.7 parts was externally added. Thus, magnetic toners 27 to 30 are obtained. The physical properties of the toners 27 to 30 are shown in Table 4, respectively.

Examples 24 and 25

Using the magnetic toners 28 and 29, evaluations were performed under the same conditions as those of Example 1. The results are shown in Table 5.

Comparative Examples 4 and 5

Using the magnetic toners 27 and 30, evaluations were performed under the same conditions as those of Example 1. The results are shown in Table 5.

From the results of Example 24 and Comparative Example 4, it is found that the transfer property and the fogging become worse when the weight-average particle diameter of the magnetic toner become smaller, and the charging property is also decreased. When the weight-average particle diameter is 3 μm or more, it is found that the concentration difference of the ghost portion can be suppressed to 0.20 or less.

As is evident from Example 24 and Comparative Example 5, it is found that the resolution decreases as the weight-average particle diameter of the magnetic toner increases. In addition, it is found that when the weight average particle diameter is 12 μm or less, there is no problem in the resolution.

TABLE 4

| Magnetic toner No. | Metallic-compound fine particles No. | Inorganic fine powder | Weight average particle diameter of magnetic toner |
|---|---|---|---|
| 27 | 1 | Silica 1 | 2.8 μm |
| 28 | 1 | Silica 1 | 3.0 μm |
| 29 | 1 | Silica 1 | 12.0 μm |
| 30 | 1 | Silica 1 | 12.5 μm |

TABLE 5

| Example No. | Magnetic toner No. | Normal temperature/normal humidity: Transfer property | Fog (%) | Image density | Resolution | High temperature/high humidity: Transfer property | Fog (%) | Image density | Low temperature/low humidity: Transfer property | Fog (%) | Image density | Density difference at ghost portion |
|---|---|---|---|---|---|---|---|---|---|---|---|---|
| Example 24 | 28 | 71 | 2.2 | 1.40 | A | 70 | 2.4 | 1.39 | 70 | 2.6 | 1.38 | 0.19 |
| Example 25 | 29 | 89 | 0.5 | 1.41 | C | 89 | 0.6 | 1.40 | 90 | 0.4 | 1.40 | 0.03 |
| Comparative example 4 | 27 | 70 | 2.4 | 1.38 | A | 68 | 2.6 | 1.37 | 67 | 2.9 | 1.36 | 0.31 |
| Comparative example 5 | 30 | 90 | 0.5 | 1.39 | D | 89 | 0.6 | 1.38 | 90 | 0.4 | 1.39 | 0.03 |

Examples 26 to 30

The experimental conditions of this example were as follows. During the period corresponding to the paper-to-paper period (i.e, at the time when the printer performs no image recording), a charge-bias application power source was switched using a sequence control circuit to connect the AC voltage in series to the DC voltage to apply a combination of the following voltages on the metal core 2*a* of the charging roller 2, and magnetic toner 1 was used as toner.

DC voltage: −650 V

AC voltage: superposed voltage of rectangular waves having a peak-to-peak voltage of 200 V, and frequencies of 3 Hz, 5 Hz, 500 Hz, 1000 Hz, and 1010 Hz Furthermore, at the time of paper-to-paper period, just as at the time of image recording, the developing sleeve 4*a* of the developing device 4 received the application of a combination of the following voltages.

DC voltage: −440 v

AC voltage: superposed voltage of a rectangular wave having a peak-to-peak voltage of 1500 V, and a frequency of 1.6 kHz.

By keeping these bias relationships, the magnetic toner, being negatively triboelectrically charged on the charging roller 2, was developed on the photoconductor 1 (the toner on the charging roller 2 is discharged to the photoconductor 1), and the magnetic toner can be recovered with back contrast by the developing device 4.

At the time of image recording by the printer, the printing conditions were just as in Example 1, and the charging property was evaluated under the conditions of low temperature and low humidity using the magnetic toner 1 in the same way as that of Example 1. In this example, however, the ghost images were successively printed on 10 sheets of paper, and the evaluation was conducted on the 10th sheet of paper. The results are shown in Table 6.

TABLE 6

| Example No. (Magnetic toner 1 is used) | Frequency (Hz) of the superposed AC voltage applied to the charging member | Low temperature/low humidity | | | | |
|---|---|---|---|---|---|---|
| | | Transfer property | Fog (%) | Image density | Density difference at ghost portion | Image characteristics |
| Example 26 | 3 | 86 | 0.6~1.1 | 1.43~1.46 | 0.03 | Uneven density depending on frequency is generated |
| Example 27 | 5 | 86 | 0.8 | 1.44 | 0.03 | Uneven density is almost prevented |
| Example 28 | 500 | 86 | 0.8 | 1.45 | 0.04 | No uneven density |
| Example 29 | 1000 | 86 | 1.0 | 1.46 | 0.05 | No uneven density |
| Example 30 | 1010 | 86 | 1.1 | 1.47 | 0.07 | No uneven density |

Examples 31 and 32

Next, the frequency of the superposed AC voltage at the time of the paper-to-paper period was 500 Hz, and the magnetic toners 17 and 20 were used to conduct the evaluation of images just as in Example 28. The results are shown in Table 7.

TABLE 7

| Example No. (500 Hz is applied) | Magnetic toner | Low temperature/low humidity | | | |
|---|---|---|---|---|---|
| | | Transfer property | Fog (%) | Image density | Density difference at ghost portion |
| Example 28 | 1 | 86 | 0.8 | 1.45 | 0.04 |
| Example 31 | 17 | 89 | 0.4 | 1.44 | 0.03 |
| Example 32 | 20 | 90 | 0.2 | 1.46 | 0.02 |

The toner of the present invention is applied in the above process conditions to effectively remove the toner adhered on the charging member, which may cause deterioration in the charging property at the time of non-image recording, so that an excellent electronic property can be maintained.

When the frequency of the superposed AC voltage to the charging member is low, uneven density (the phenomenon in which light and shaded parts occur in turn) is generated in synchronization with the frequency. On the other hand, when the frequency is high, the toner adhered on the charging member hardly follows the frequency and becomes difficult to be removed. The charging property is slightly lowered. It is found that there is no problem when the frequency is in the range of 5 to 1000 Hz.

Production Examples 2 and 3 of Photoconductor

Photoconductor 2 was produced by the same way as that of Production Example 1 of the photoconductor, except that the usage amount of the resole thermosetting phenol resin was changed to 30 parts. Photoconductors 3 was also produced by the same way as that of Production Example 1 of the photoconductor, except that the usage amount of the resole thermosetting phenol resin was changed to 15 parts. The values of We-OCL(%) of the photoconductors 2, 3 were 45.4 and 40.6, respectively.

Examples 33 to 35

Under the same conditions as those of Example 28, except that the peripheral speed of a rotation of the charging roller 2 in the direction of the arrow Y was 200% (a relative movement-speed ratio of 300% with respect to the surface of photoconductor 21), the experiments were conducted using the photoconductors 1 to 3 in combination with the magnetic toner 1. The evaluation of charging property was performed as follows. That is, about 0.5 g of a mixture of metallic-compound fine particles 1 and magnetic toner 1 (1:1) is applied on surface of the used charging roller 1, followed by printing ghost images successively on 5 sheets of paper and making an evaluation on the image on the 5th sheet. The evaluation was conducted at the beginning and after printing 10000 sheets of paper. The results are shown in Table 8.

TABLE 8

| | | Low temperature/low humidity | | | | |
|---|---|---|---|---|---|---|
| | | | | | Density difference at ghost portion | |
| Example No. | Photo-conductor | Transfer property | Fog (%) | Image density | Begin-ning | After 1000 sheets |
| Example 33 | 1 | 86 | 0.7 | 1.43 | 0.01 | 0.04 |
| Example 34 | 2 | 86 | 0.5 | 1.42 | 0.02 | 0.06 |
| Example 35 | 3 | 86 | 0.4 | 1.41 | 0.03 | 0.09 |

As is evident from the results of Examples 33 to 35, it is found that the toner of the present invention and the photoconductor that satisfy expression (1) are combined to prevent the generation of fog and maintain a favorable charging property in the cleanerless system for a long time. In addition, when the value of We-OCL(%) is close to the upper limit of expression (1), the fogging tends to become worse, while the charging property tends to deteriorate due to the scraped surface layer when it is close to the lower limit. It is also found that there is no problem when the value is in the range of expression (1).

Examples 36 and 37

The same experiment as that of Example 34 was performed using the magnetic toners 17, 20 and the photoconductor 2. The results are shown in Table 9.

TABLE 9

| | | Low temperature/low humidity | | | | |
|---|---|---|---|---|---|---|
| | | | | | Density difference at ghost portion | |
| Example No. | Magnetic | Transfer property | Fog (%) | Image density | Begin-ning | After 1000 sheets |
| Example 26 | 1 | 86 | 0.5 | 1.42 | 0.02 | 0.06 |
| Example 27 | 17 | 89 | 0.2 | 1.43 | 0.01 | 0.02 |
| Example 28 | 20 | 88 | 0.2 | 1.45 | 0.01 | 0.01 |

As is evident from Examples 34, 36, and 37, it is found that the toner of the present invention and the photoconductor that satisfy expression (1) are appropriately combined to prevent the generation of fog and keep the charging property favorably for a long time even under the low-humidity environment in the cleanerless system.

As described above, according to the present invention, the toner having excellent performance for image characteristics can be obtained. In particular, using such toners in a cleaning-simultaneous-with-developing system using a direct injection charging mechanism, it becomes possible to obtain excellent performances for charging property.

Furthermore, high-image quality printing without a ghost image to be caused by a poor charging property becomes possible for a long time by combining the toner with a specific image forming method and a photoconductor.

What is claimed is:

1. A magnetic toner comprising at least:

magnetic toner particles;

non-magnetic, metallic-compound fine particles on the surface of said magnetic toner particles comprising at least tin oxide fine particles containing antimony treated with iso-butyl trimethoxysilane or amino-modified silicone oil; and inorganic fine powder also existing on the surface of said toner particles, wherein:

said magnetic toner particles comprise at least a binder resin and a magnetic iron oxide;

the weight-average particle diameter A of said magnetic toner is 3.0 μm to 12.0 μm; and said non-magnetic, metallic-compound fine particles are conductive metallic-compound fine particles which have:

a specific surface area, measured in units of $cm^2/cm^3$, of $5\times10^5$ to $100\times10^5$;

a $D_{50}$ median diameter of 0.4 μm to 4.0 μm with respect to a volume-based particle diameter distribution, the median diameter $D_{50}$ being smaller than the weight-average particle diameter A of the magnetic toner; and a 90% particle diameter $D_{90}$ of 6.0 μm or less with respect to a volume-based particle diameter distribution.

2. The toner recited in claim 1, wherein the specific surface area measured in units of $cm^2/cm^3$ and the $D_{50}$ median diameter measured in units of μm of said non-magnetic, metallic-compound fine particles satisfy the following relationship:

$$5\times10^5/D_{50} \leqq \text{specific surface area} \leqq 100\times10^5/D_{50}.$$

3. The toner recited in claim 1, wherein the percentage content by weight X of said non-magnetic, metallic-compound fine particles and the specific gravity Y, measured in $g/cm^3$, satisfy the following relationship:

$$0.5 \leqq X\times Y \leqq 6.0.$$

4. The toner recited in claim 1, wherein said non-magnetic, metallic-compound fine particles have a volume resistivity of $1\times10^{-1}$ to $1\times10^{9}$ Ωcm.

5. The toner recited in claim 1, wherein said non-magnetic, metallic-compound fine particles have the median diameter $D_{50}$ of 0.5 μm to 3.5 μm with respect to a volume-based particle diameter distribution.

6. The toner recited in claim 1, wherein said non-magnetic, metallic-compound fine particles have a 90% particle diameter $D_{90}$ of 4.0 μm or less with respect to a volume-based particle diameter distribution.

7. The toner recited in claim 1, wherein said non-magnetic, metallic-compound fine particles have a 10% particle diameter $D_{10}$ of 0.3 μm or more with respect to a volume-based particle diameter distribution.

8. The toner recited in claim 1, wherein said non-magnetic, metallic-compound fine particles have a specific surface area of $10\times10^5$ $cm^2/cm^3$ to $80\times10^5$ $cm^2/cm^3$.

9. The toner recited in claim 1, wherein said non-magnetic, metallic-compound fine particles have a specific surface area of $12\times10^5$ $cm^2/cm^3$ to $40\times10^5$ $cm^2/cm^3$.

10. The toner recited in claim 1, wherein said non-magnetic, metallic-compound fine particles have a 10% particle diameter $D_{10}$ of 0.4 μm or more with respect to a volume-based particle diameter distribution.

11. The toner recited in claim 1, wherein:

said inorganic fine powder is selected from a group consisting of silica, titanium oxide, alumina, and complexes thereof and mixtures thereof; and the average primary particle diameter of said inorganic fine powder is 4 nm to 80 nm.

12. The toner recited in claim 1, wherein the Carr floodability index thereof is more than 80.

* * * * *

UNITED STATES PATENT AND TRADEMARK OFFICE

CERTIFICATE OF CORRECTION

PATENT NO. : 7,141,343 B2
APPLICATION NO. : 10/418215
DATED : November 28, 2006
INVENTOR(S) : Tsuyoshi Takiguchi et al.

It is certified that error appears in the above-identified patent and that said Letters Patent is hereby corrected as shown below:

ON THE TITLE PAGE

At Item (56), Other Publications, insert --Grant, Roger et al., Grant and Hachk's Chemical Dictionary, New York: McGraw-Hill, Inc., (1987), pp. 549-550.--.

COLUMN 3

Line 46, "discussion" should read --discussion in--.

COLUMN 7

Line 34, "as a" should read --as an--.

COLUMN 10

Line 3, "80 mm" should read --80 nm--.

COLUMN 13

Line 20, "calculated" should read --calculated.--.

COLUMN 14

Line 24, "foodability" should read --floodability--.
Line 26, "foodability" (both occurrences) should read --floodability--.
Line 32, "foodability" should read --floodability--.
Line 38, "foodability" should read --floodability--.
Line 42, "foodability" should read --floodability--.
Line 48, "Cycromix" should read --Cyclomix--.

COLUMN 16

Line 20, "2-etylhexyl" should read --2-ethylhexyl--.

COLUMN 19

Line 24, "hydrogenarated" should read --hydrogenated--.
Line 44, in equation (F), "x" should read -- x' --, and "y" should read -- y' --.
Line 59, "dicarbocylates" should read --dicarboxylates--.

COLUMN 20

Line 8, "1,2,5-benzen" should read --1,2,5-benzene--.
Lines 9 and 10 "tricarbocylic acid" should read --tricarboxylic acid--.

COLUMN 21

Line 3, "stylene" should read --styrene--.

UNITED STATES PATENT AND TRADEMARK OFFICE

CERTIFICATE OF CORRECTION

PATENT NO. : 7,141,343 B2
APPLICATION NO. : 10/418215
DATED : November 28, 2006
INVENTOR(S) : Tsuyoshi Takiguchi et al.

It is certified that error appears in the above-identified patent and that said Letters Patent is hereby corrected as shown below:

COLUMN 22
Line 28, "aid." should read --acid.--.
Line 49, "naphtyl" should read --naphthyl--.
Line 55, "(1)," should read --(I),--.
Line 58, "thereof)." should read --thereof.--.

COLUMN 23
Line 4, "ammounium" should read --ammonium--.
Line 22, "metacrylic" should read --methacrylic--.
Line 34, "$R^1$" should read --$R_1$--.

COLUMN 30
Line 34, "a" should read --an--.

COLUMN 32
Line 22, "hummer" should read --hammer--.

COLUMN 34
Line 17, "an" should read --a--.

COLUMN 36
Line 65, "75g/m2" should read --75g/$m^2$--.

COLUMN 41
Line 4, "10′" should be deleted.

COLUMN 42
In Table 2, in the row including magnetic toner No. 20, "Silica 2" should read --Silica 1--.
In Table 2, in the row including magnetic toner No. 22, "Alumima$^{(*3)}$" should read --Alumina$^{(*3)}$--.
In Table, 2, in footnote *1, "8 mn)" should read --8 nm)--.
In Table 3, in the rightmost column, the heading "Density difference a ghost portion" should read --Density difference at a ghost portion--.

COLUMN 44
In Table 3, in the rightmost column, the heading "Density difference a ghost portion" should read --Density difference at a ghost portion--.

COLUMN 45
Line 5, "(i.e," should read --(i.e.,--.

UNITED STATES PATENT AND TRADEMARK OFFICE

CERTIFICATE OF CORRECTION

PATENT NO. : 7,141,343 B2
APPLICATION NO. : 10/418215
DATED : November 28, 2006
INVENTOR(S) : Tsuyoshi Takiguchi et al.

It is certified that error appears in the above-identified patent and that said Letters Patent is hereby corrected as shown below:

COLUMN 46
Line 34, "was" should read --were--.

COLUMN 47
Line 6, "10000" should read --1000--.

COLUMN 48
Line 21, "cm, $^{3}$" should read --$cm^3$,--.
Line 41, "g/cm, $^{3}$" should read --$g/cm^3$,--.

Signed and Sealed this

Twenty-sixth Day of June, 2007

JON W. DUDAS
*Director of the United States Patent and Trademark Office*